US007588044B2

(12) United States Patent
Baker

(10) Patent No.: US 7,588,044 B2
(45) Date of Patent: Sep. 15, 2009

(54) FOOT ASSEMBLY FOR A WALKING AID

(76) Inventor: William H. Baker, 3212 NW. 35th St., Oklahoma City, OK (US) 73112

( * ) Notice: Subject to any disclaimer, the term of this patent is extended or adjusted under 35 U.S.C. 154(b) by 0 days.

(21) Appl. No.: 11/707,297

(22) Filed: Feb. 13, 2007

(65) Prior Publication Data

US 2008/0035193 A1 Feb. 14, 2008

Related U.S. Application Data

(60) Provisional application No. 60/837,167, filed on Aug. 11, 2006.

(51) Int. Cl.
*A45B 9/04* (2006.01)

(52) U.S. Cl. ..... 135/82; 135/84

(58) Field of Classification Search ..... 135/77, 135/82, 84, 86

See application file for complete search history.

(56) References Cited

U.S. PATENT DOCUMENTS

| | | | | | |
|---|---|---|---|---|---|
| 108,303 | A | | 10/1870 | Tuttle | |
| 679,468 | A | | 7/1901 | Pratt | |
| 710,074 | A | | 9/1902 | Pratt | |
| 765,984 | A | | 7/1904 | Morris | |
| 1,031,247 | A | | 7/1912 | Conrad | |
| 1,348,531 | A | | 8/1920 | Amadio | |
| 1,369,580 | A | | 2/1921 | Uchyth | |
| 1,504,902 | A | | 8/1924 | Rosenhein | |
| 1,733,430 | A | * | 10/1929 | Shahan | 135/82 |
| 2,116,730 | A | | 5/1938 | Menton | |
| 2,397,499 | A | * | 4/1946 | Mcgowan | 135/82 |
| 2,429,409 | A | | 10/1947 | Eidman | |
| 2,492,916 | A | | 12/1949 | Chute et al. | |
| 2,501,890 | A | | 3/1950 | Desso | |
| 2,666,608 | A | | 1/1954 | Holm | |
| 2,753,586 | A | | 7/1956 | Metz | |
| 2,910,995 | A | * | 11/1959 | Jacuzzi | 135/77 |
| 3,099,103 | A | | 7/1963 | Wright | |
| 3,170,475 | A | | 2/1965 | Forbes | |
| 3,199,886 | A | | 8/1965 | Dover | |
| 4,135,536 | A | | 1/1979 | Willis | |
| 4,411,284 | A | | 10/1983 | Opitz | |
| 4,440,186 | A | | 4/1984 | Lottner | |
| 4,510,957 | A | | 4/1985 | Frank | |
| 4,708,154 | A | | 11/1987 | Edwards | |
| 4,947,882 | A | | 8/1990 | Levasseur | |
| 5,307,828 | A | | 5/1994 | Gardner et al. | |
| 5,713,382 | A | * | 2/1998 | Midcap | 135/84 |
| 5,954,075 | A | * | 9/1999 | Gilmour | 135/84 |
| 6,138,699 | A | | 10/2000 | Su | |
| 6,883,530 | B2 | | 4/2005 | Kawakami | |

* cited by examiner

*Primary Examiner*—David Dunn
*Assistant Examiner*—Noah Chandler Hawk

(57) ABSTRACT

The invention is for a foot assembly for a walking aid. The foot assembly is attached to a strut at a lower end of the walking aid. The foot assembly has a cylinder attached to a bottom of the strut and a foot pivotally attached to the cylinder by a foot bolt. The foot has a hemispherical portion and a flat ring portion. The foot bolt is positioned through a dome hole and a cylinder bottom opening, and the foot bolt is secured by a foot bolt nut that tightens on the foot bolt threads to attach the foot dome hemispherical portion to a concave cylinder bottom wall. A resilient foot pad is attached to a bottom of the foot. A spacer fits on the foot bolt and retains the foot bolt head inside the hemispherical portion.

13 Claims, 23 Drawing Sheets

FOOT ASSEMBLY FOR A WALKING AID

RELATED APPLICATIONS

The invention relates to U.S. Provisional Patent Application No. 60/837,167 filed Aug. 11, 2006 and co-pending applications with Ser. Nos. 11/707,814 and 11/707,815.

BACKGROUND

Mankind has long used various shapes and sizes of sticks as supportive aids in their mobility. Over the past century or so, what is today commonly called a crutch has evolved into more specialized shapes. Those devices that are currently considered as traditional crutches aid mobility, but their design and use may also contribute to the development of significant medical problems.

As these walking aids have evolved, the primary focus appears to have followed the following design objective: reduce the cost of manufacturing to enhance mass production and marketing capabilities. The previous designs for walking aids have lacked ergonomic design objectives addressing medical problems related to the disabilities and have failed to reduce or eliminate these problems.

Three specific medical problems resulting from using the traditional crutch are: (1) injury from loss of traction, (2) carpal tunnel syndrome, and (3) neuropathy. While the first of these problems may be obvious to the general public, the other problems are not as obvious. Carpal tunnel syndrome is a painful or numb condition of the wrist and hand resulting when tissues that form a tunnel-like passage in the wrist swell and pinch a nerve within the passage. Repetitive movement, as in typing or knitting, often causes this condition.

The handle of a typical crutch is generally round like a dowel, which offers little, if any resistance to rotation of the hand and wrist. Because medical practitioners recommend using the handle to provide principal support for the body weight, rather than the shoulder supports, this using of the handle places abnormal pressure on the forearms, hands and wrists of the user. Without adequate and proper stability for these members, carpal tunnel syndrome may result from long-term use of the typical crutch.

Neuropathy is any disease to the nervous system. In the case of long-term crutch users, the term neuropathy describes damage to nerves in the shoulder or underarm area resulting from use of the traditional crutch. Carrying the body weight on the shoulder support, unfortunately, is quite common. A significant contributing cause of neuropathy is attributed to this abnormal pressure and to the shoulder absorbing repeated impact when the crutch makes contact with the supporting surface.

According to the U.S. Census Data, the total number of people in all age groups in the U.S. with disabilities is about 51 million. *U.S. Census Bureau, June-September* 2002 *Data from the Survey of Income and Program Participation*. Of those 51 million people, about 9.1 million people use a walker, a crutch or a cane. Id. Thus, there is a large population that may benefit from improvements in the design of walking aids. The incidence of injury from loss of traction, carpal tunnel syndrome, and neuropathy within these groups indicates that the medical problems associated with use of traditional crutches have not been adequately addressed in the design of walking aids.

Once adjusted for a particular user, the traditional crutch is designed to have a single configuration. That configuration has a fixed length, which becomes a problem when navigating a changing environment, such as stairs, curbs, restaurants, and other obstacles.

It is to solving these and other problems that the present invention is directed.

DESCRIPTION

Figure 1:
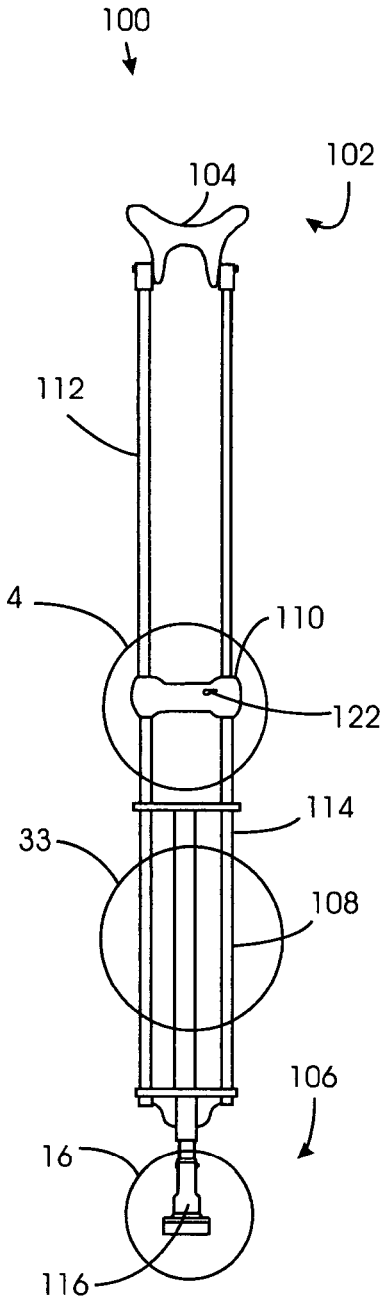
FIG. 1 shows a side elevation view of an adjustable crutch constructed in accordance with a preferred embodiment of the present invention.
Figure 2:
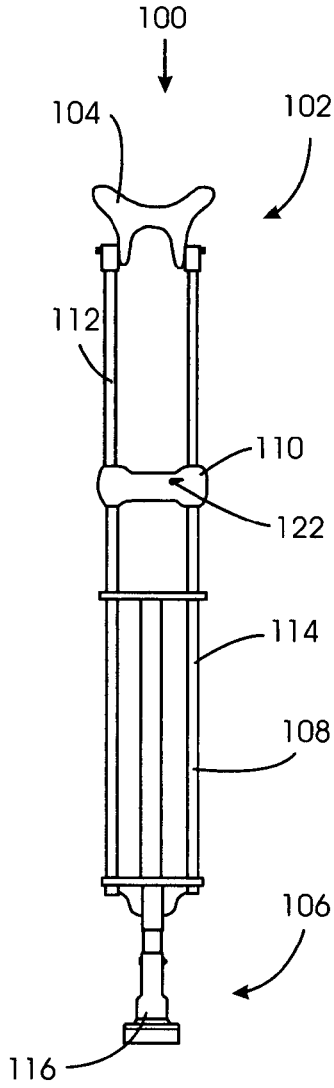
FIG. 2 shows a side elevation view of an adjustable crutch constructed in accordance with a preferred embodiment of the present invention.
Figure 3:
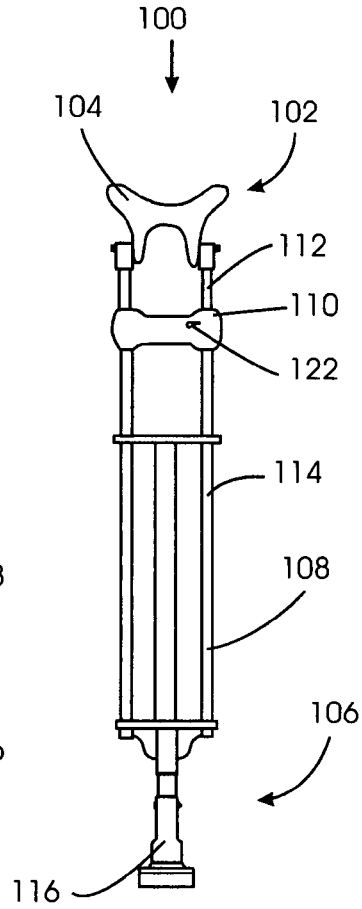
FIG. 3 shows a side elevation view of an adjustable crutch constructed in accordance with a preferred embodiment of the present invention.

FIGS. 1-3 show a side elevation view of an adjustable crutch 100 of the present invention. The crutch 100 has an upper portion 102 with a shoulder support 104 that fits beneath an underarm of a user. The crutch 100 has a lower portion 106 connected to the upper portion 102 by a frame 108. The frame 108 has a handle 110 for the user to grasp for lifting and moving the crutch 100 during walking and primary support of their weight otherwise.

The upper portion 102 also includes two upper tubes 112 that telescope inside lower tubes 114, which are part of the frame 108. The two upper tubes 112 are substantially parallel to one another and the two lower tubes 114 are substantially parallel to one another. As will be better described in regard to FIGS. 4-6, the handle 110 fits atop the lower tubes 114. The lower portion 106 also has a foot assembly 116 that engages the ground when the user is walking with the crutch 100.

Figure 6:
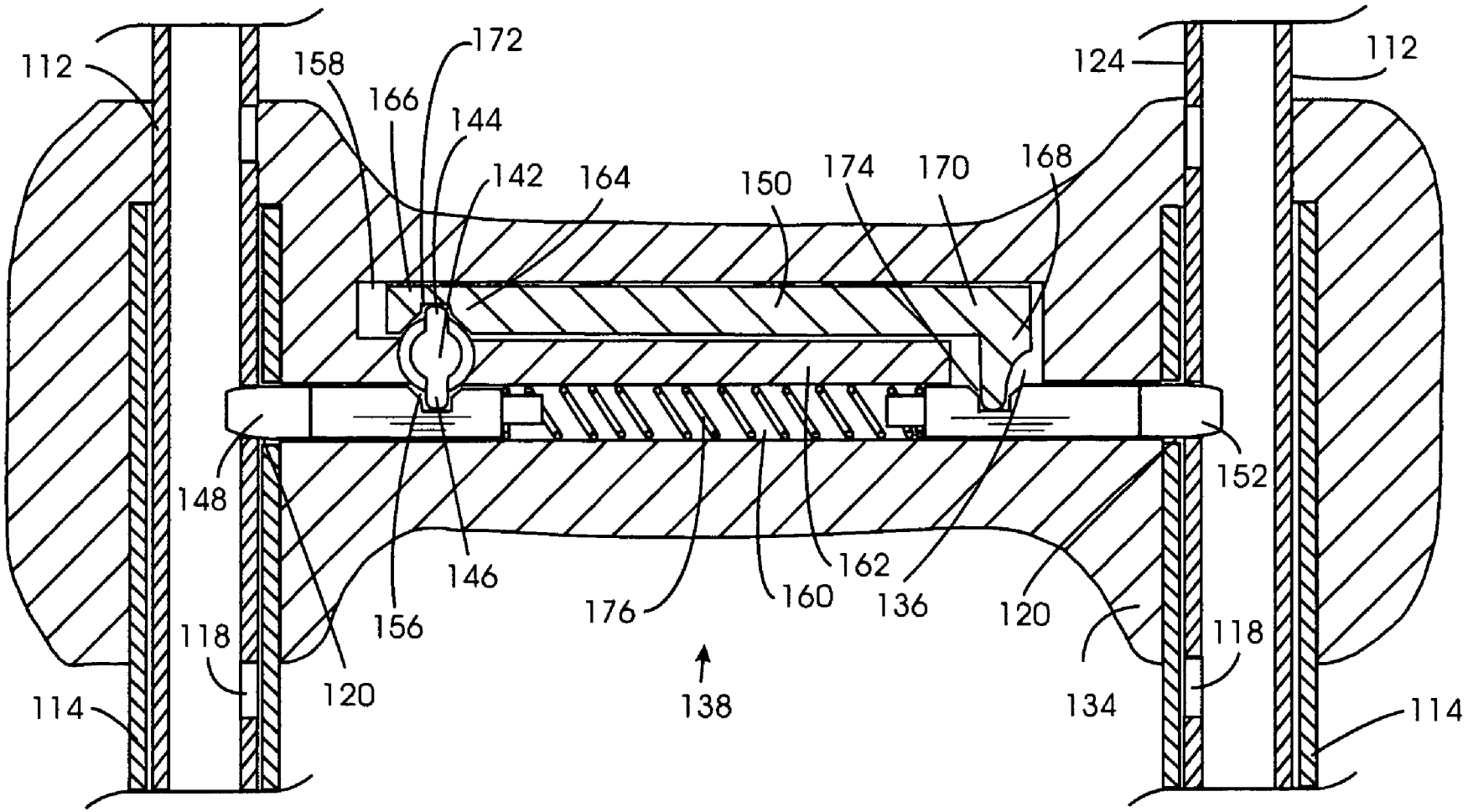
FIG. 6 shows a cross-sectional view of the cross section 6-6 shown in FIG. 5.
Figure 7:
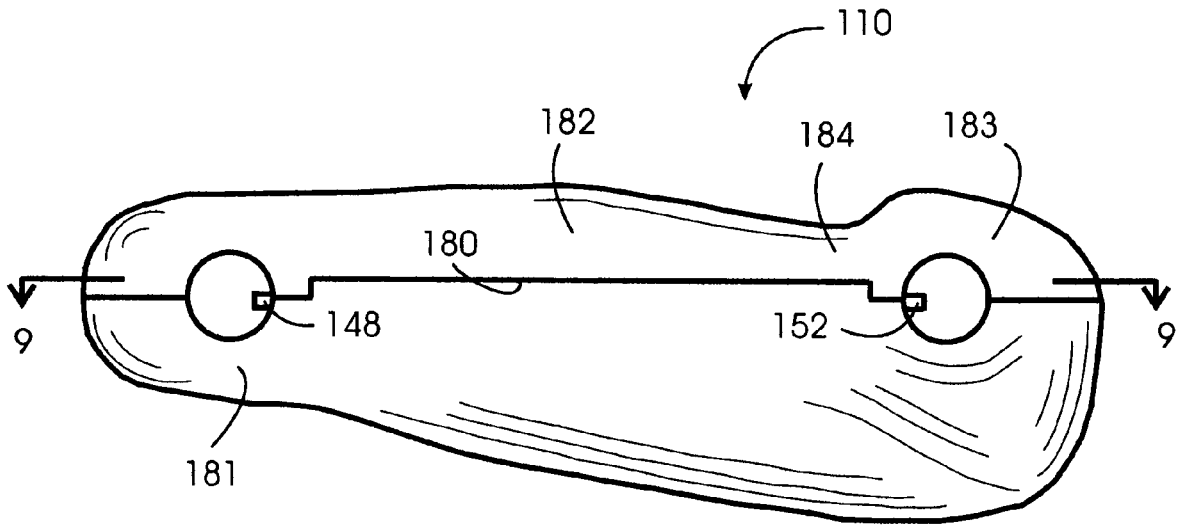
FIG. 7 shows a top view of a handle in accordance with a preferred embodiment of the present invention.

As best seen in FIG. 6, tube holes 118 are defined along a length of each of the two upper tubes 112 such that the tube holes 118 are substantially aligned with and facing one another. Tube openings 120 are defined in each of the lower tubes 114 such that the tube openings 120 are substantially aligned with and facing one another. A diameter D1 of each upper tube 112 is slightly smaller than a diameter D2 of each lower tube 114 so that the upper tubes 112 slide freely inside the lower tubes 114.

As will be further discussed in regard to FIG. 6, the handle 110 includes two locking pins 148,152 that are normally biased in an extended position to fit into the tube holes 118 and the tube openings 120 when the upper tubes 112 slide inside the lower tubes 114. The locking pins 148,152 are moved to a retracted position by operating a lever 122. When the lever 122 is depressed, the locking pins 148, 152 retract and the upper tubes 112 are free to slide inside the lower tubes 114. When the lever 122 is released, the locking pins 148,152 are biased to the extended position and engage an outer wall 124 of the upper tube 112 as the upper tubes slide inside the lower tube 114.

Figure 4:
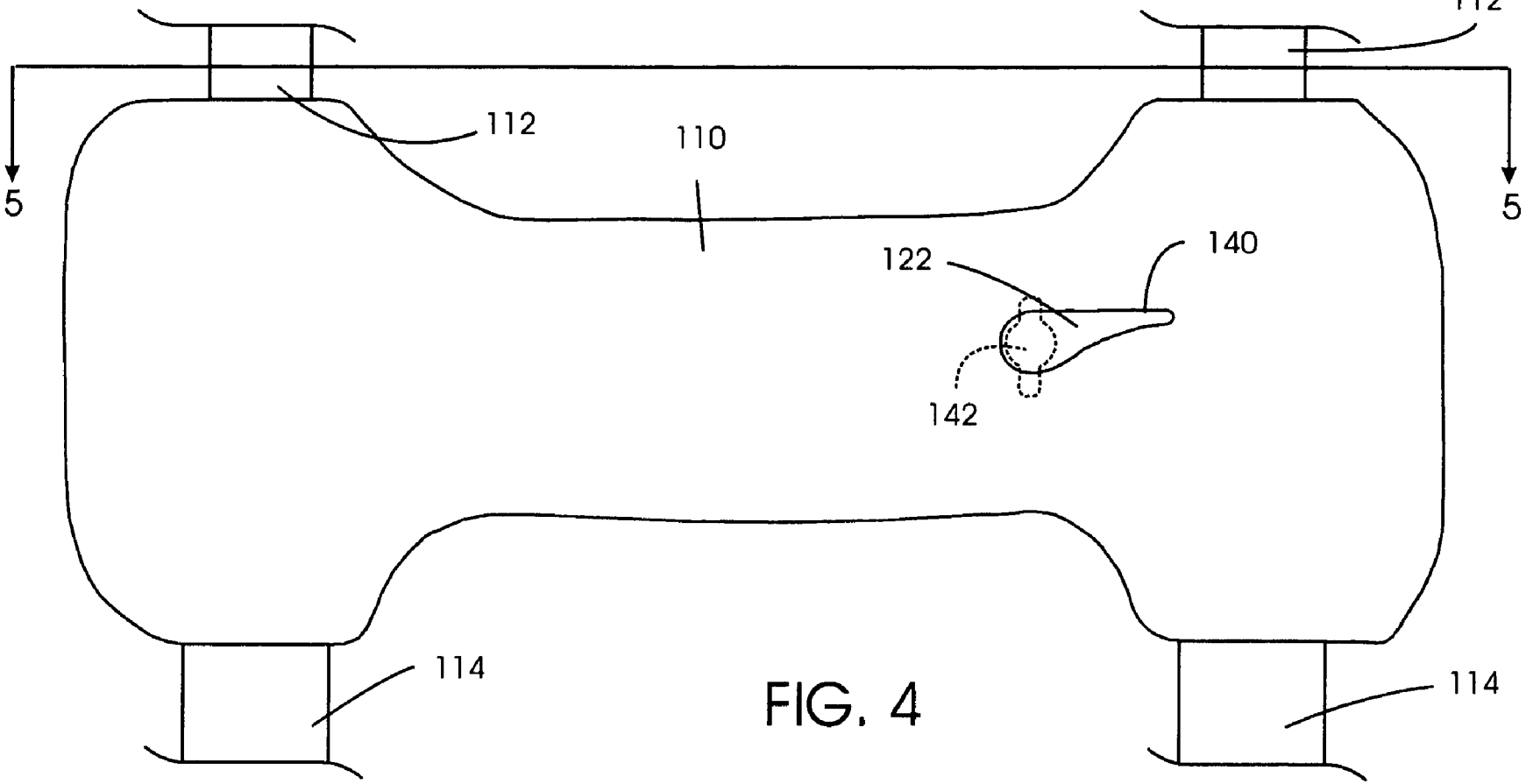
FIG. 4 shows a detailed view of the handle assembly shown in FIG. 1.
Figure 5:
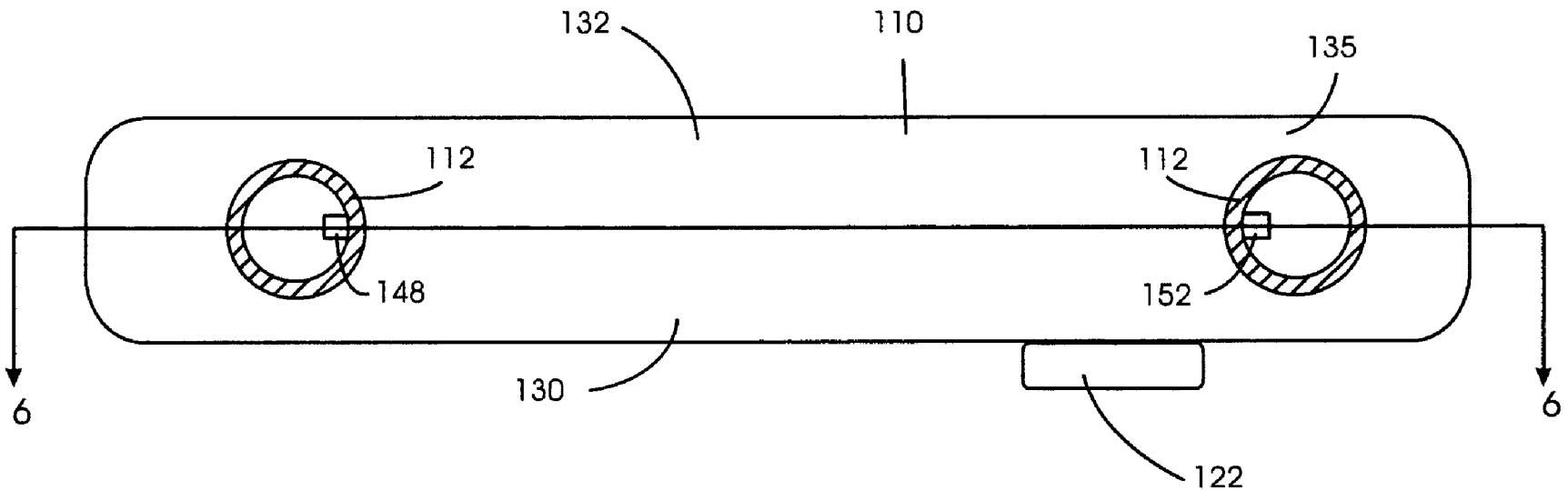
FIG. 5 shows a cross-sectional view of the cross section 5-5 shown in FIG. 4.

FIGS. 4-6 show the handle 110 used with the crutch 100 of the present invention. The handle 110 is shaped to fit a wide variety of human hands. The handle 110 is generally cylindrical in shape, has an average diameter of 2.5 to 5 centimeters (1 to 2 inches) and is typically 10 to 20 centimeters (4 to 8 inches) in length. The handle is formed from a first half-body 130 and second half-body 132 that fit together to form a body 135 of the handle 110. For the embodiment shown in FIGS. 4-6, the first half-body 130 is identical to the second half-body 132. Both half-bodies 130 and 132 have an inner face 134 with channels 136 defined therein to receive the working parts of a lock/release mechanism 138 for moving the locking pins 148 and 152 between the extended and the retracted positions. A handle assembly includes the handle 110 and a lock/release mechanism 138.

Figure 13:
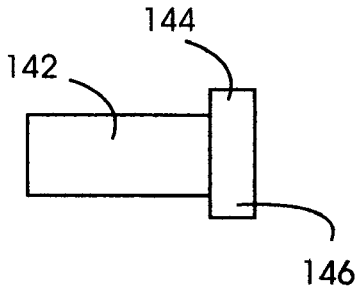
FIG. 13 shows a side elevation view of the spindle shown in FIG. 9.
Figure 14:
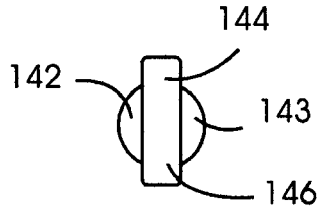
FIG. 14 shows an end view of the spindle shown in FIG. 13.

FIG. 6 shows the lock/release mechanism 138 of the present invention. Individual parts of the lock/release mechanism 138 are shown in FIGS. 13-16. FIGS. 13-14 show an end view and a cross-sectional view of the lever 122. FIGS. 13 and 14 show a side elevation view and an end view of a spindle 142 with integrally-formed upper paddle 144 and lower paddle 146.

Returning to FIG. 6, the lock/release mechanism 138 includes the lever 122 that is depressed and released by the user to operate the lock/release mechanism 138. The lever 122 has a thumb portion 140 attached to a spindle 142 by a set screw. As best seen in FIGS. 11-14, the spindle 142 fits into a bore 141 formed in the lever 122. The spindle 142 has a round portion 143 and the two diametrically opposed paddles, upper paddle 144 and lower paddle 146. The upper paddle 144 and lower paddle 146 engage a first locking pin 148 and a slide 150. The first locking pin 148, the slide 150 and a second locking pin 152 are housed in the channel 136 defined in the second half-body 132. During assembly of the handle 110 and lock/release mechanism 138, the spindle 142 fits through spindle opening 154 defined in one of the two handle half bodies 130 and 132, into the bore 141 and the lever 122 is secured to the spindle 142 by the set screw. The first locking pin 148 has a notch 156 defined therein to receive the lower paddle 146.

The channel 136 has a first chamber 158 to receive the slide 150 and a second chamber 160 to receive the first and second locking pins 148 and 152. The first chamber 158 is separated from the second chamber 160 by wall 162.

The slide 150 is a generally L-shaped structure with a paddle-engaging portion 164 at a slide first end 166 and an angle piece 168 at a slide second end 170. The paddle-engaging portion 164 has a slide notch 172 defined therein to receive the upper paddle 144. The angle piece 168 fits into a second locking pin notch 174.

A compression spring 176 extends between the first locking pin 148 and the second locking pin 152. The compression spring 176 has a length L selected such that the locking pins 148 and 152 are biased in the extended position when the locking pins 148 and 152 are positioned in the second chamber 160. The spring constant of the compression spring 176 is selected to permit easy operation of the lock/release mechanism 138 by a disabled person with very little hand strength. Thus, the range of acceptable spring constants may vary from 0.5 lbs/in to 5 lbs/in (0.0875 kN/m to 0.875 kN/m).

Concerning the operation of the lock/release mechanism 138, it is first noted that the locking pins 148 and 152 are normally biased in the extended position by the compression spring 176. When the user depresses the thumb portion 140 of the lever 122, the spindle 142 rotates the paddles 144, 146 in a counterclockwise direction for the lock/release mechanism 138 shown in FIG. 6. When the spindle 142 rotates, the lower paddle engages the first locking pin 148 in the notch 156. When the lower paddle 146 engages the first locking pin 148, the first locking pin 148 is moved toward the second locking pin 152. Simultaneously, the upper paddle 144 engages the slide 150 in the slide notch 172, and the slide 150 in turn exerts a force on the second locking pin 152 in the direction of the first locking pin 148, thus compressing the spring 176. When the slide 150 hits an outer wall of the chamber 158, the locking pins 148 and 152 are in the retracted position.

When the user releases the lever thumb portion 140, the compressed spring 176 pushes the first locking pin 148 and the second locking pin 152 away from one another so that the slide 150 and the first locking pin 148 return to their original extended position. Thus, the slide 150 and the first locking pin 148 engage the lower and upper paddles 144, 146 to rotate the wheel portion 142 back to the original position of the wheel portion 142, which in turn returns the lever 122 to its original position.

FIGS. 7-10 show another embodiment of the handle 110. For this embodiment, the handle half-bodies 130 and 132 are not identical. Rather, the first half body 130 contains all the working parts of the lock/release mechanism 138, while the second half-body 132 has a blank inner face 180 without channels defined therein. The lock/release mechanism 138 shown in FIG. 9 operates substantially the same as the lock/release mechanism 138 shown in FIG. 6 and described above with regard to FIG. 6. However, the arrangement of the lock/release mechanism 138 within the handle half-body 130 is reversed. Thus, the spindle 142 is shown as being on the left in FIG. 6, but as being on the right in FIG. 9. This change in orientation does not affect how the lock/release mechanism 138 operates. The upper tubes 112 and the lower tubes 114 are not shown in FIG. 9 for the sake of simplicity, but the sliding of the upper tubes inside the lower tubes is identical to that shown and described for the embodiment shown in FIG. 6.

Another important aspect of the handle 110 is a handle external geometry. The handle external geometry is designed to prevent or minimize the occurrence of carpal tunnel syndrome in long-term crutch users. FIGS. 7-10 illustrate some of the external features of the handle 110 designed to prevent carpal tunnel syndrome. It is first noted that a particular handle 110 is designed to be used by only the right hand or the left hand of a person. The embodiment shown in FIGS. 7-10 is designed to fit and be used by only a person's left hand.

Figure 8:
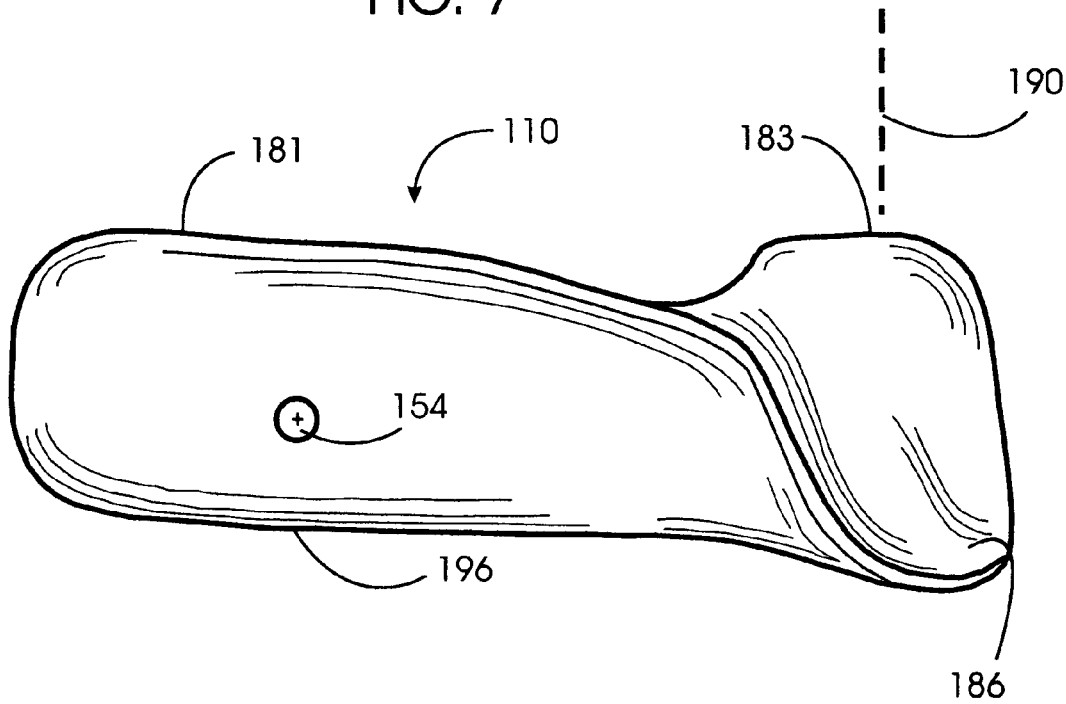
FIG. 8 shows an elevation view of the handle shown in FIG. 7.
Figure 9:
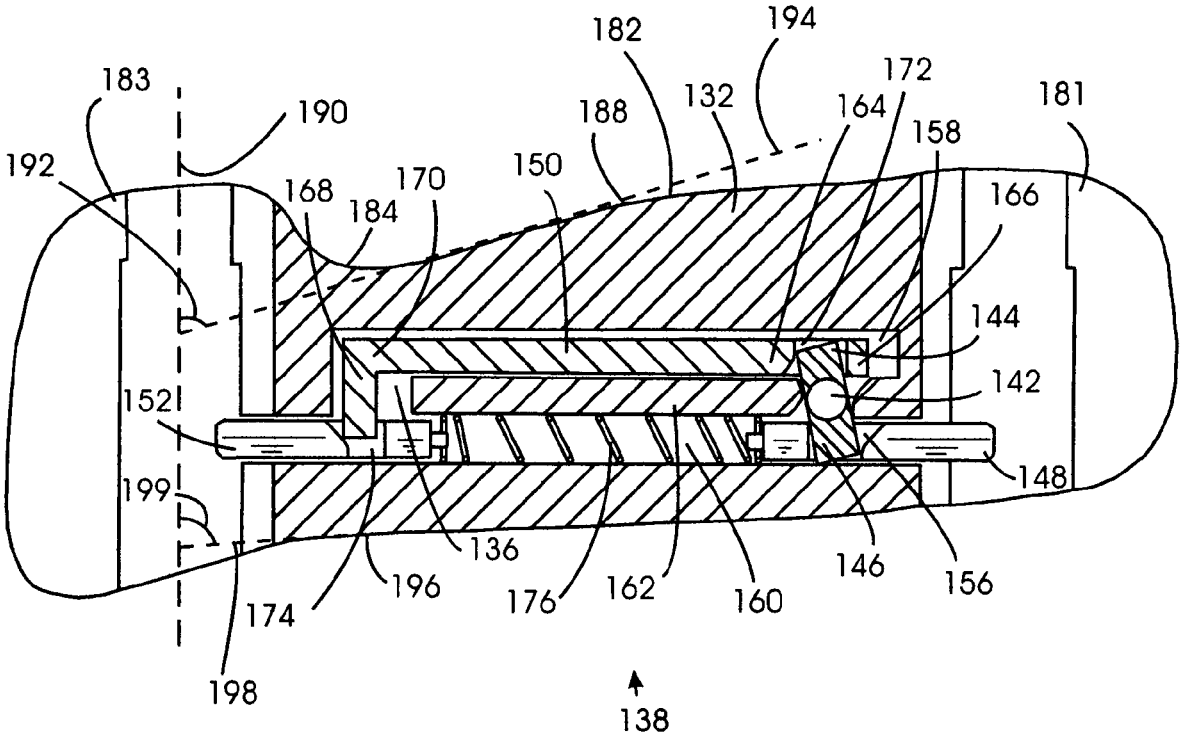
FIG. 9 shows a cross sectional view of the cross section 9-9 shown in FIG. 7.
Figure 10:
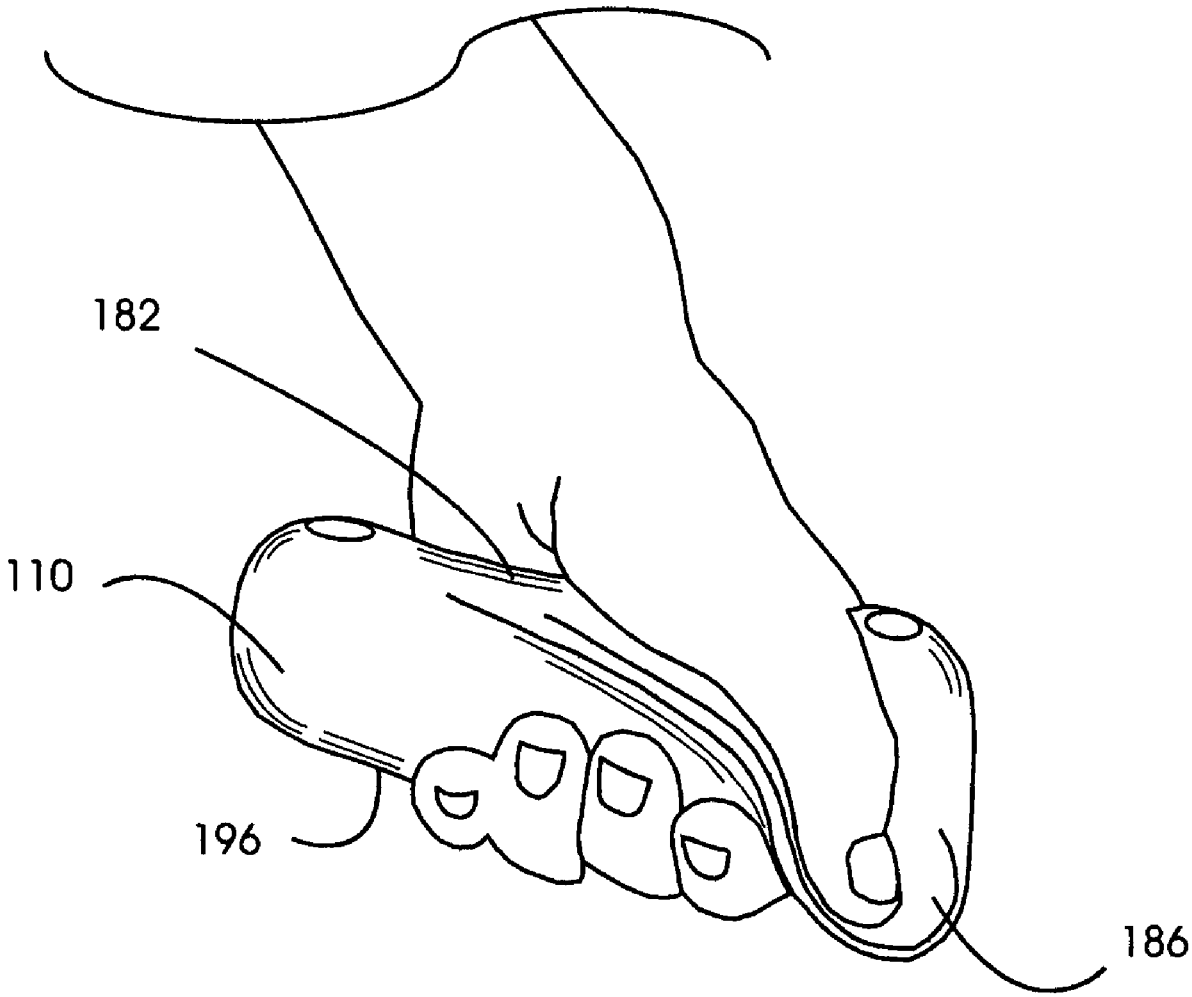
FIG. 10 shows a perspective view of a human hand holding the handle shown in FIG. 8.
Figure 11:
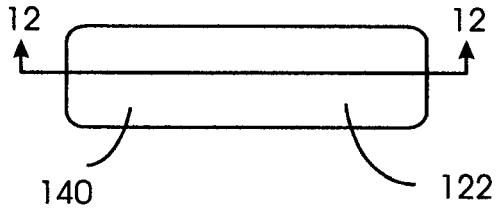
FIG. 11 shows a top view of a lever on the handle assembly shown in FIG. 9.
Figure 12:
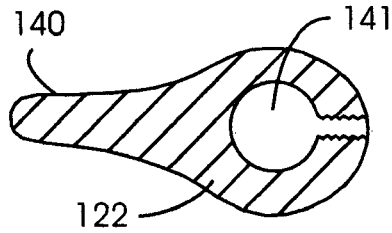
FIG. 12 shows a cross-sectional view of the cross-section 12-12 of the lever shown in FIG. 11.

The handle 110 has a body 111 with a rear post 181, a front post 183, and a palm grip 182 where the person's palm contacts the handle 110 upon gripping. The handle 110 also has a web 184 where a web of a person's hand between the thumb and the first finger contacts the handle 110 upon gripping. The handle 110 has a thumb rest 186 where the user's thumb is positioned when gripping the handle 110. The thumb rest 186 is a contoured ridge formed on a side of the handle 110 that is slightly wider than a person's thumb. FIGS. 8-9 show an imaginary line 190 that is parallel to a centerline of the lower tubes 114.

An uppermost portion of the palm grip 182 is on top of the handle 110. The handle 110 is contoured downward from an uppermost portion of the palm grip 182 to the thumb rest 186 along a gripping contour surface 188. A plane 194 tangent to the gripping contour surface 188 forms a gripping angle 192 with the imaginary line 190, which is shown in FIG. 9. The gripping angle 192 has a value that is between seventy and seventy-five degrees, and is optimally about seventy-three degrees. This range of values of the gripping angle 192 provides a comfortable and natural fit for the human hand and helps to position the hand without undue stresses acting on the muscles and tendons of the hand and wrist and to restrict rolling and twisting motions of hands and wrists that contribute to carpal tunnel syndrome.

A bottom gripping surface 196 of the handle 110 extends from the rear post 181 to the front post 183. An imaginary plane 198 substantially tangent to the bottom gripping surface 196 intersects the imaginary line 190 at a lower surface angle 199. The lower surface angle 199 has a measure between eighty and eighty-five degrees and has an optimal value of about eighty-three degrees. This range of values for the lower surface angle 199 also helps to naturally position the hand such that undue stresses are not placed on the muscles and tendons of the hand and wrist and positions the hand to restrict rolling and twisting motions of hands and wrists that contribute to carpal tunnel syndrome.

A weight-bearing surface area of the palm grip 182 near the rear post 181 is about twice as large as a weight-bearing surface area of the web 184 near the front post 183, which encourages a user to bear his weight on the palm of the hand instead of the web of the hand. This also contributes to reducing the rolling and twisting motions that contribute to carpal tunnel syndrome. The thumb rest 186 also provides a surface to position the thumb that physiologically and a psychologically encourages the user to refrain from the twisting and rolling motions that contribute to carpal tunnel syndrome.

In one embodiment, the first half-body 130 and the second half-body 132 of the handle 110 are assembled together by screws. The screws fit into screw holes defined in the first half-body 130 and the second half-body 132 of the handle 110. Threads are defined in borders of the screw holes so that the screws tighten against the threads.

The handle half-bodies 130 and 132 may be made of any suitable material. Suitable materials include, but are not limited to, plastic, resins, wood, metal, ceramic or composite material. Furthermore, although the handle 110 is shown as being formed by two half-bodies, it is also contemplated that the handle 110 may have a unitary body molded around a lock/release mechanism 138.

The individual parts of the lock/release mechanism 138 may be plastic, metal, composite material or any other suitable material.

Figure 16:
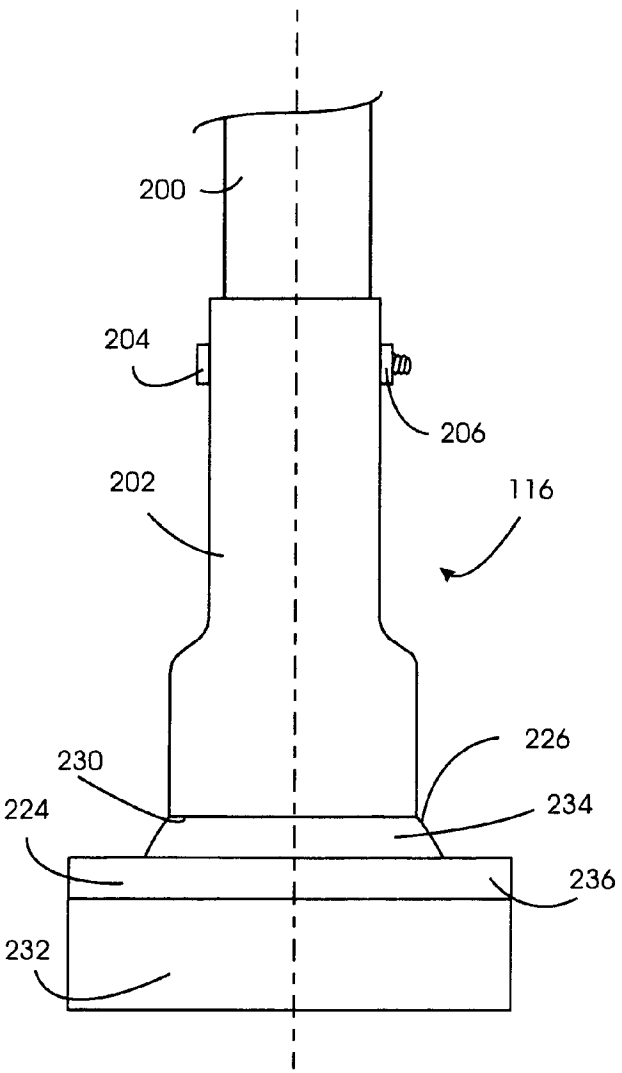
FIG. 16 shows a side elevation view of the foot assembly shown in FIG. 1.
Figure 15:
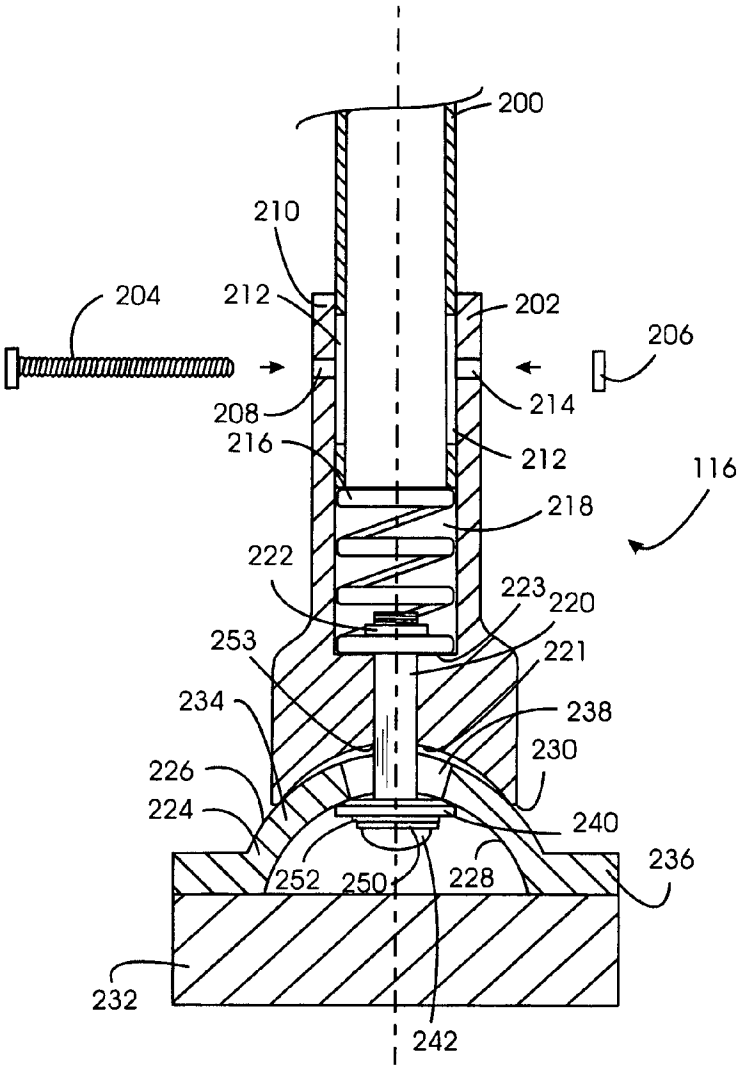
FIG. 15 shows a cross-sectional view of the foot assembly shown in FIG. 1.

The foot assembly 116 for the adjustable multipurpose crutch 100 is shown in detail in FIGS. 15-19. FIG. 15 shows a cross-sectional view of one embodiment of the foot assembly 116 while FIG. 16 shows a side elevation view of the same embodiment. Although the foot assembly 116 is shown as being attached to the bottom of the crutch 100, it is understood that the foot assembly 116 could also be attached to the bottom of other walking aids, such as canes, walkers, other types of crutches and walking sticks.

In FIGS. 15-16, a strut 200 extends downward from the bottom of the crutch 100. A cylinder 202 is attached to strut 200 by a through-bolt 204 and secured with jam nut 206. The through-bolt 204 fits through a first opening 208 in the cylinder wall 210, a pair of opposed, elongated strut slots 212, through a second opening 214, and the jam nut 206 is tightened to a predetermined torque around threads on the through-bolt 204. Because the strut 200 has the elongated slots 212, the strut 200 is not rigidly fastened to the cylinder 202, but is free to travel the height of the elongated slots 212.

The strut 200 rests atop a spring 216 positioned in a cylinder void 218. The cylinder 202 is pivotally attached by a foot bolt 220 and foot nut 222 to a dome-shaped foot 224. The foot nut 222 is another jam nut tightened to a predetermined torque, so that the dome-shaped foot 224 is not rigidly secured against the cylinder 200. This lack of rigidity in the joint formed between the dome-shaped foot 224 and the cylinder 202 permits the foot 224 to swivel about the foot bolt 220, which in turn allows the foot assembly 116 to adapt to the supporting surface up to an angle of about 25 degrees. The dome-shaped foot 224 has an outside upper surface 226 and an inside upper surface 228. A cylinder lower edge 230 rides on top of the foot 224 outside upper surface 226 as the cylinder 202 rotates about the foot 224 in an orbital or swivel-type motion. A resilient foot pad 232 is attached to a bottom of the foot 224 by an adhesive.

The dome-shaped foot 224 has a hemispherical portion 234 and a flat ring portion 236. A dome hole 238 in the hemispherical portion 234 allows passage of the foot bolt 220. A spacer 240 is positioned on the foot bolt 220 near the foot bolt head 242 so that the foot bolt 220 is secured within the dome-shaped foot 224. The dome hole 238 is a hole in the hemispherical portion 234. The spacer 240 is disc-shaped and has a lower surface 244 with a lower diameter and an upper surface 246 with an upper diameter. The lower diameter is slightly larger than the lower diameter and the spacer 240 has a tapered edge 248 from the lower surface 244 to the upper surface 246. The upper diameter of the spacer 240 is selected so that the spacer 240 cannot be forced through the dome hole 238. The lower diameter of the spacer 240 is selected so that the tapered edge 248 substantially engages the inside upper surface 228 along the tapered edge 248.

Two washers 250 and 252 are located between the head of the foot bolt 224 and the spacer 240. The first washer 250 is a flat washer. The second washer 252 is a Belleville washer. A Belleville washer is conical or slightly cupped so that the Belleville washer has a spring characteristic. This spring characteristic provides a slight amount of flexibility in the joint formed between the cylinder 202 and the foot 224, which in turns causes the cylinder 202 to more freely rotate about the foot 224. It is well-known in the art that Belleville washers may be stacked in the same direction to give a higher effective spring constant to a joint or in opposite directions to reduce the stiffness of a joint. Thus, if it is found the joint between the cylinder 202 and the foot 224 is too loose or too tight, one may add more Belleville washers stacked in the same or opposite directions.

After passing through the dome hole 238, the foot bolt passes through a cylinder bottom opening 253 and engages the foot nut 222. Tightening the foot nut 222 on the foot bolt 220 to its predetermined torque secures the joint formed between the cylinder 202 and the foot 224. Although FIG. 15 is generally a cross-sectional view, the spring 216, the foot bolt 220, the spacer 240, the washers 250 and 252, the through bolt 204 and 206 are represented as a side elevation view.

Figure 15A:
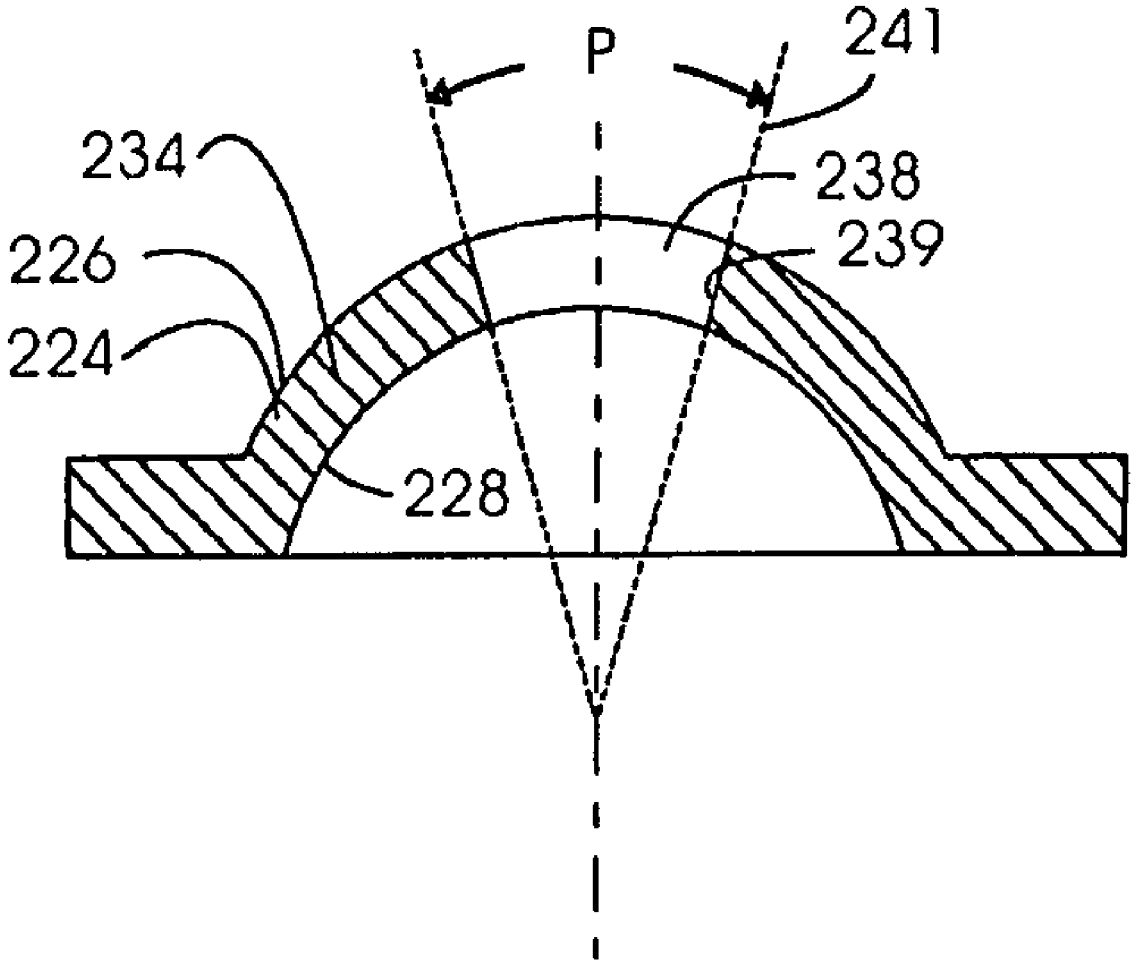

FIG. 15A shows a cross-sectional view of the foot dome shown in FIG. 15. As shown in FIG. 15A, the dome hole 238 has a circumferential wall 239 that defines an imaginary cone 241. The imaginary cone 241 has a vertex angle P. The vertex angle P represents a spherical angle of travel of the dome-shaped foot 224 in swiveling about the foot bolt 220. As mentioned above, this design allows the foot assembly 116 to adapt to the supporting surface up to an angle of about 25 degrees.

The materials selected for the foot assembly may be any suitable materials. One suitable material for the spacer 240 may be nylon or plastic, because the spacer 240 must be durable when subjected to thousands of cycles of loading, but flexible enough so that the joint formed between the cylinder 202 and the foot 224 has some flexibility.

Figure 17:
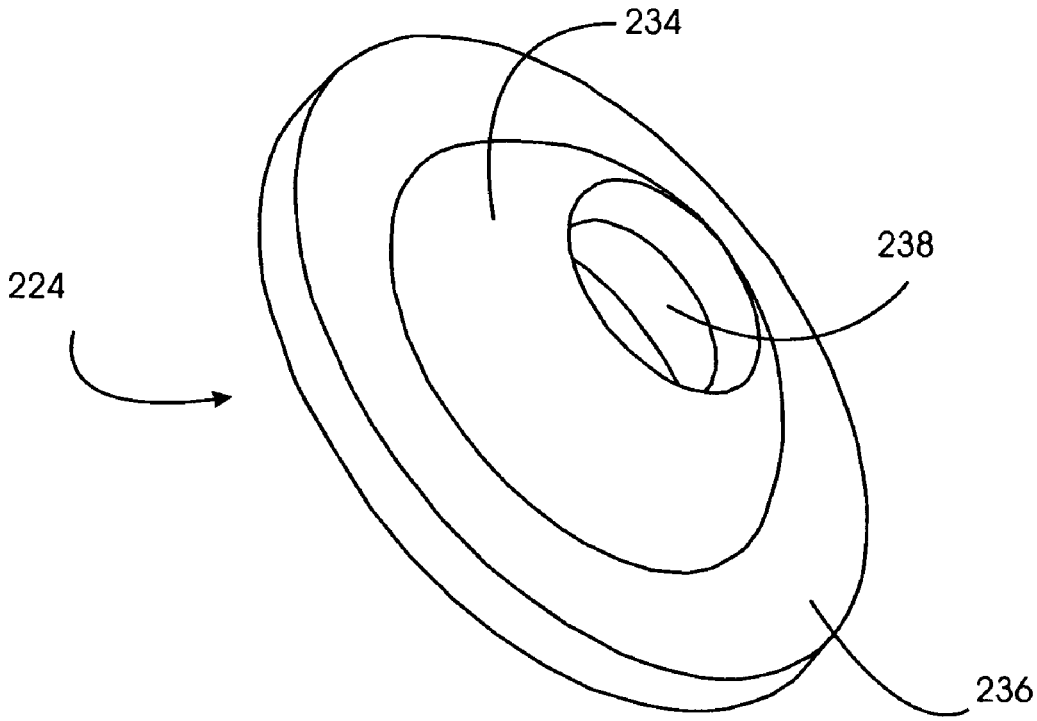
FIG. 17 shows a a perspective view of the foot shown in FIG. 15.

FIG. 17 shows a perspective view of the dome-shaped foot 224. The foot 224 has a hemispherical portion 234 and a flat ring portion 236. A dome hole 238 is located at the top of the hemispherical portion 234.

Figure 18:
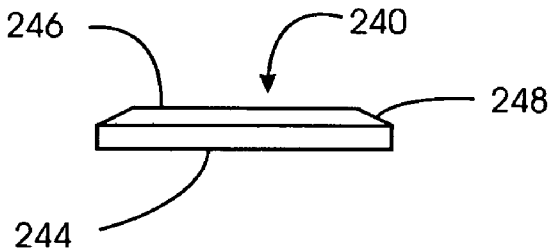
FIG. 18 shows an elevation view of the spacer shown in FIG. 15.
Figure 19:
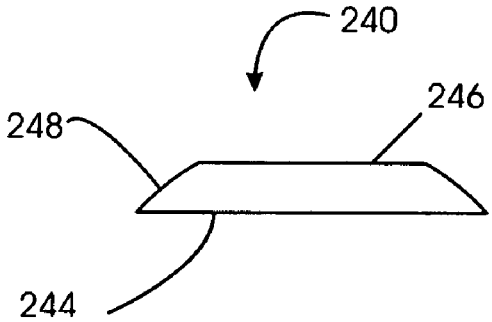
FIG. 19 shows an elevation view of alternative embodiment of the spacer shown in FIG. 18.

FIGS. 18-19 show two embodiments of spacers 240. In the first embodiment shown in FIG. 18, the spacer 240 has a lower surface 244 and an upper surface 246. The tapered edge 248 of the spacer 240 defines a wedge that substantially conforms to the inside upper surface 228 of the foot 224. In FIG. 19, the spacer 240 also has a lower surface 244 and an upper surface 246. However, the tapered edge 248 defines a portion of the surface of a sphere, so that the tapered edge 248 more closely conforms to the inside upper surface 228, as compared with the embodiment of FIG. 18.

Figure 21:
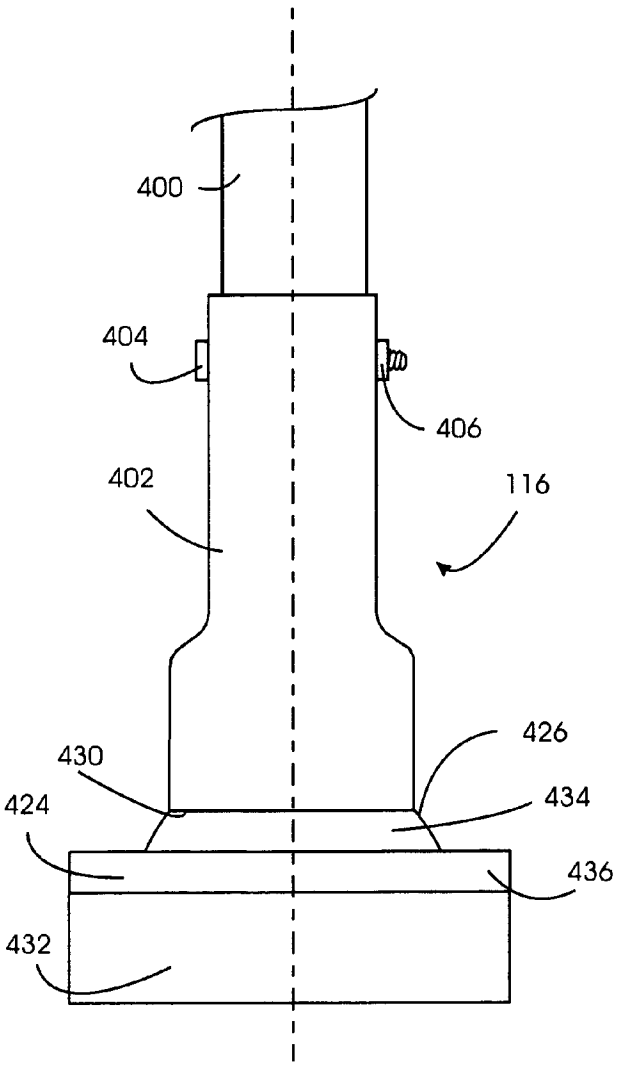
FIG. 21 shows an elevation view of the foot assembly shown in FIG. 20.
Figure 20:
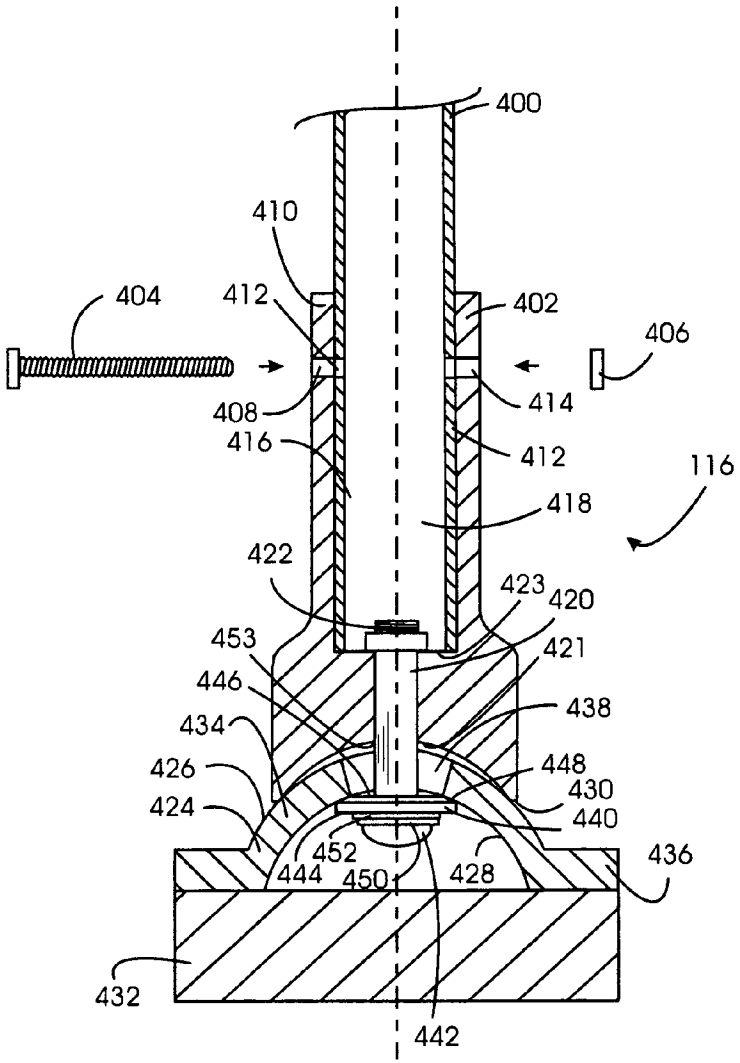
FIG. 20 shows a cross-sectional view of a foot assembly without a spring.

FIGS. 20-21 show another embodiment of a foot assembly 116 for which there is no spring as there is for the embodiment shown in FIGS. 15-16. In FIGS. 20-21, the strut 200 extends downward from the bottom of the crutch 100. A cylinder 402 is attached to strut 200 by a through-bolt 404 and secured with a jam nut 406. The through-bolt 404 fits through a first opening 408 in the cylinder wall 410, a pair of opposed, strut holes 412, through a second opening 414, and the jam nut 406 is tightened to a predetermined torque around threads on the through-bolt 404. For this embodiment, unlike the embodiment shown in FIGS. 15-16, the strut 200 is rigidly fastened to the cylinder 402.

The strut 200 rests atop a void bottom 423 positioned in a cylinder void 418. The cylinder 402 is pivotally attached by a foot bolt 420 and foot nut 422 to a dome-shaped foot 424. The foot nut 422 is another jam nut tightened to a predetermined torque, so that the dome-shaped foot 424 is not rigidly secured against the cylinder 200. This lack of rigidity in the joint formed between the dome-shaped foot 424 and the cylinder 402 permits the foot 424 to swivel about the foot bolt 420, which in turn allows the foot assembly 116 to adapt to the supporting surface up to an angle of about 25 degrees. The dome-shaped foot 424 has an outside upper surface 426 and an inside upper surface 428. A cylinder lower edge 430 rides on top of the foot 424 outside upper surface 426 as the cylinder 402 rotates about the foot 424 in an orbital or swivel-type motion. A resilient foot pad 432 is attached to a bottom of the foot 424 by an adhesive.

The dome-shaped foot 424 has a hemispherical portion 434 and a flat ring portion 436. A dome hole 438 in the hemispherical portion 434 allows passage of the foot bolt 420. A spacer 440 is positioned on the foot bolt 420 near the foot bolt head 442 so that the foot bolt 420 is secured within the dome-shaped foot 424. The dome hole 438 is a hole in the hemispherical portion 434. The spacer 440 is disc-shaped and has a lower surface 444 with a lower diameter and an upper surface 446 with an upper diameter. The lower diameter is slightly larger than the upper diameter and the spacer 440 has a tapered edge 448 from the lower surface 444 to the upper surface 446. The upper diameter of the spacer 440 is selected so that the spacer 440 cannot be forced through the dome hole 438. The lower diameter of the spacer 440 is selected so that the tapered edge 448 substantially engages the inside upper surface 428 of the hemispherical portion 434.

Two washers 450 and 452 are located between the foot bolt head 442 and the spacer 440. The first washer 450 is a flat washer. The second washer 452 is a Belleville washer.

After passing through the dome hole 438, the foot bolt passes through a cylinder bottom opening 453 and engages the foot nut 422. Tightening the foot nut 422 on the foot bolt 420 to its predetermined torque secures the joint formed between the cylinder 402 and the foot 424. Although FIG. 20 is generally a cross-sectional view, the foot bolt 420, the spacer 440, the washers 450 and 452, the through bolt 404 and the nut 406 are represented as a side elevation view.

Figure 22:
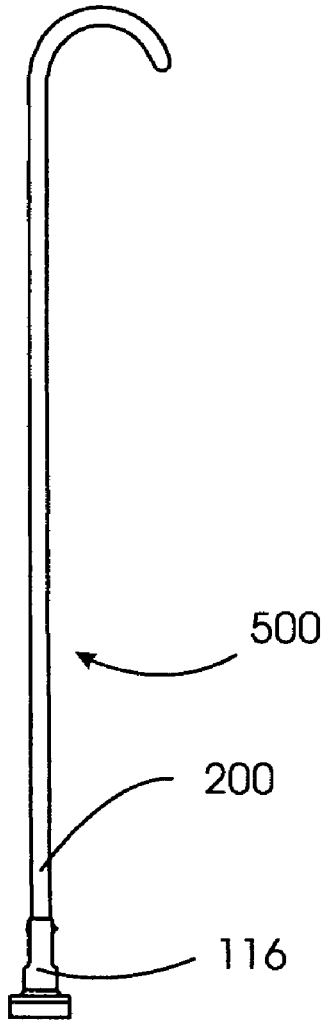
FIG. 22 shows a side elevation view of a cane with a foot assembly of the present invention.

FIG. 22 shows a cane 500 with a foot assembly 116 of the present invention attached to a strut 200 at a bottom of the cane 500.

Figure 23:
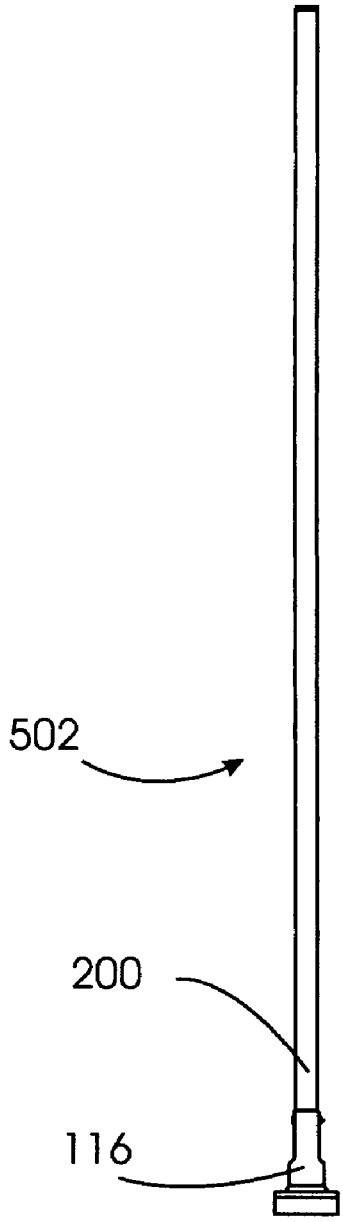
FIG. 23 shows a side elevation view of a walking stick with a foot assembly of the present invention.

FIG. 23 shows a walking stick 502 with a foot assembly 116 of the present invention attached to a strut 200 at a bottom of the walking stick 502.

Figure 24:
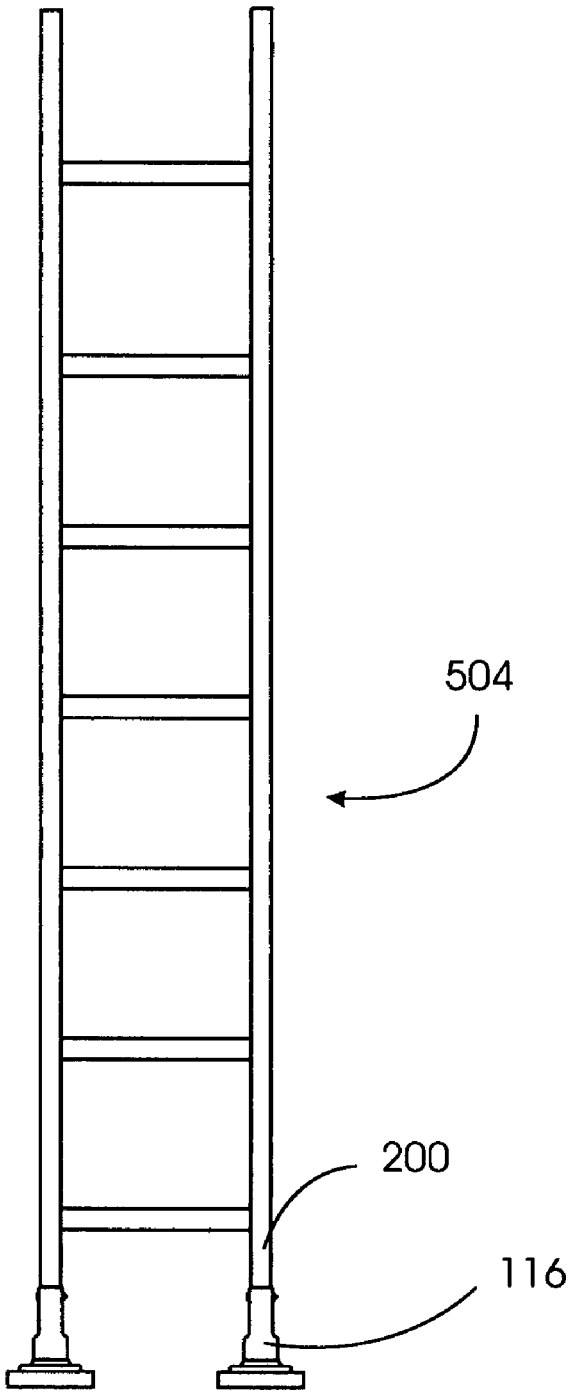
FIG. 24 shows a front view of a ladder with a foot assembly of the present invention.
Figure 25:
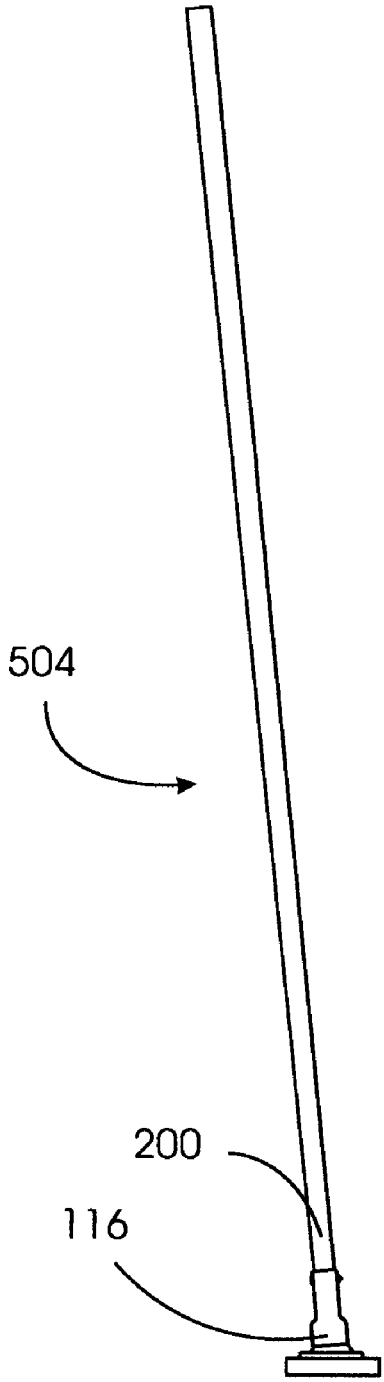
FIG. 25 shows a side elevation view of a ladder with a foot assembly of the present invention.

FIGS. 24-25 show a front elevation view and a side elevation view of a ladder 504 with a foot assembly 116 of the present invention attached to a strut 200 at a bottom of the ladder 504.

Figure 26:
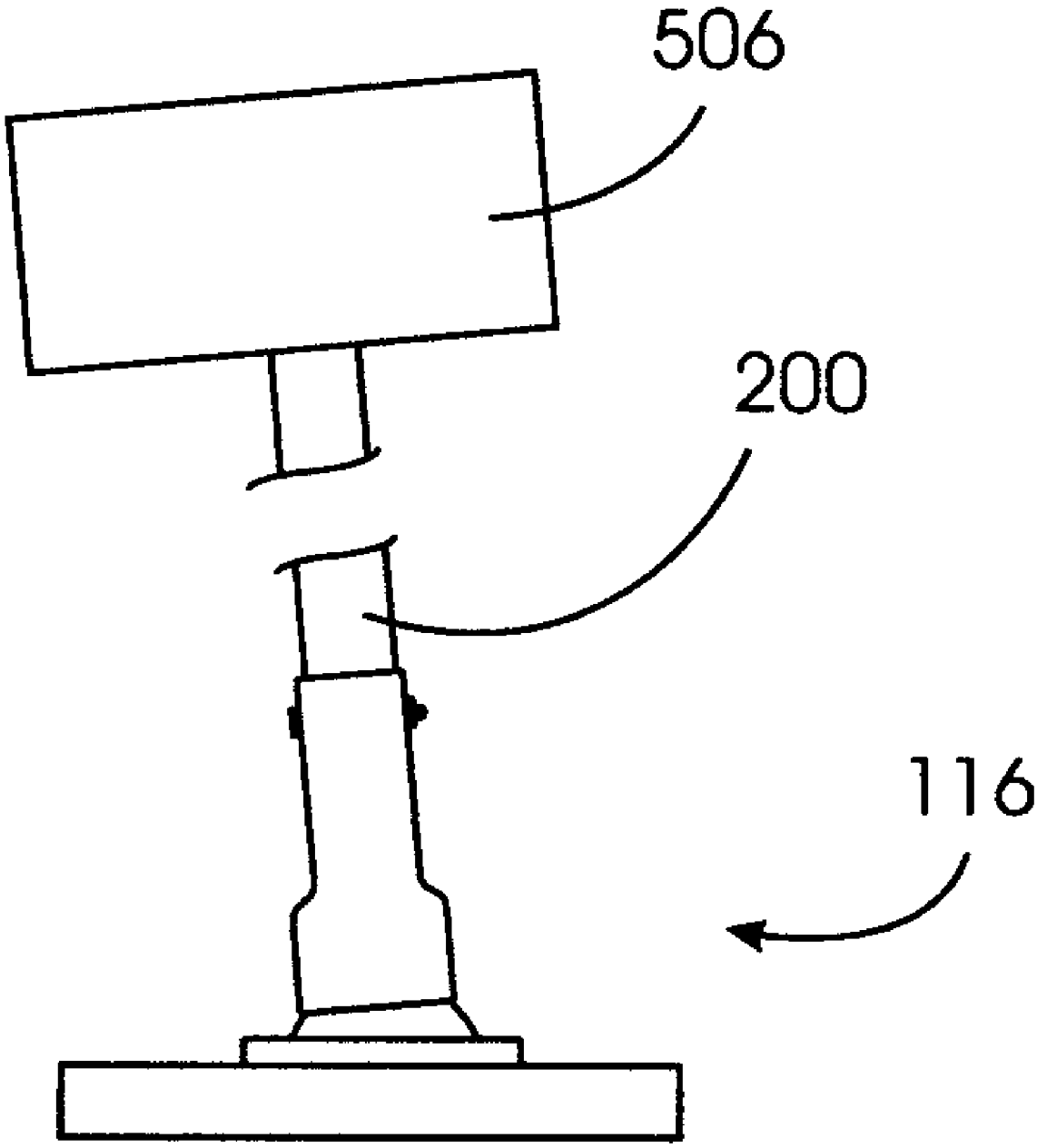
FIG. 26 shows a side elevation view of a device with a foot assembly of the present invention.

FIG. 26 shows a device 506 with a foot assembly 116 of the present invention attached to a strut 200 at a bottom of the device 506. The device may be a chair or table with the strut 200 being a leg of the chair or table. The device may also be motor mounts, shock absorbers, or any other device that is supported by a foot assembly.

Figure 27:
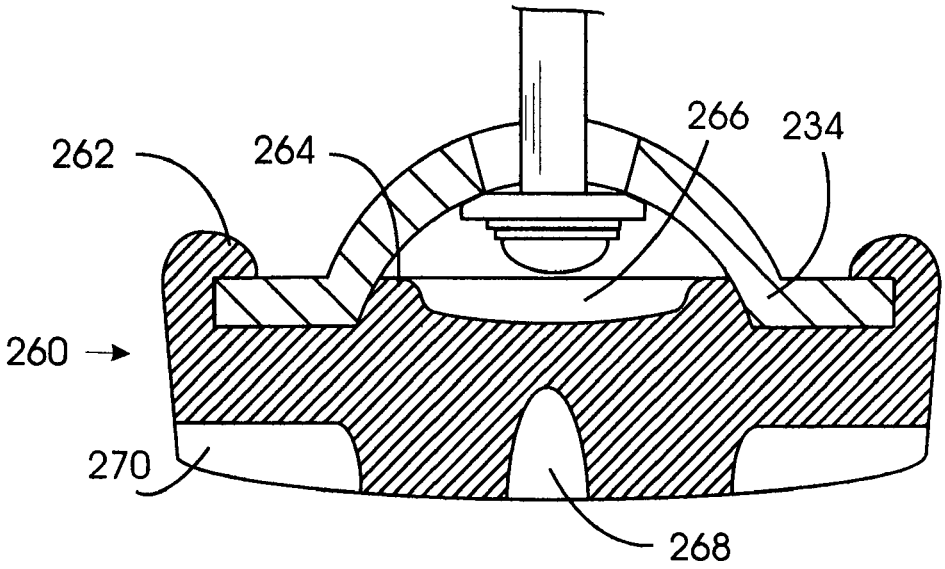
FIG. 27 shows a cross-sectional view of a foot pad of the present invention.
Figure 28:
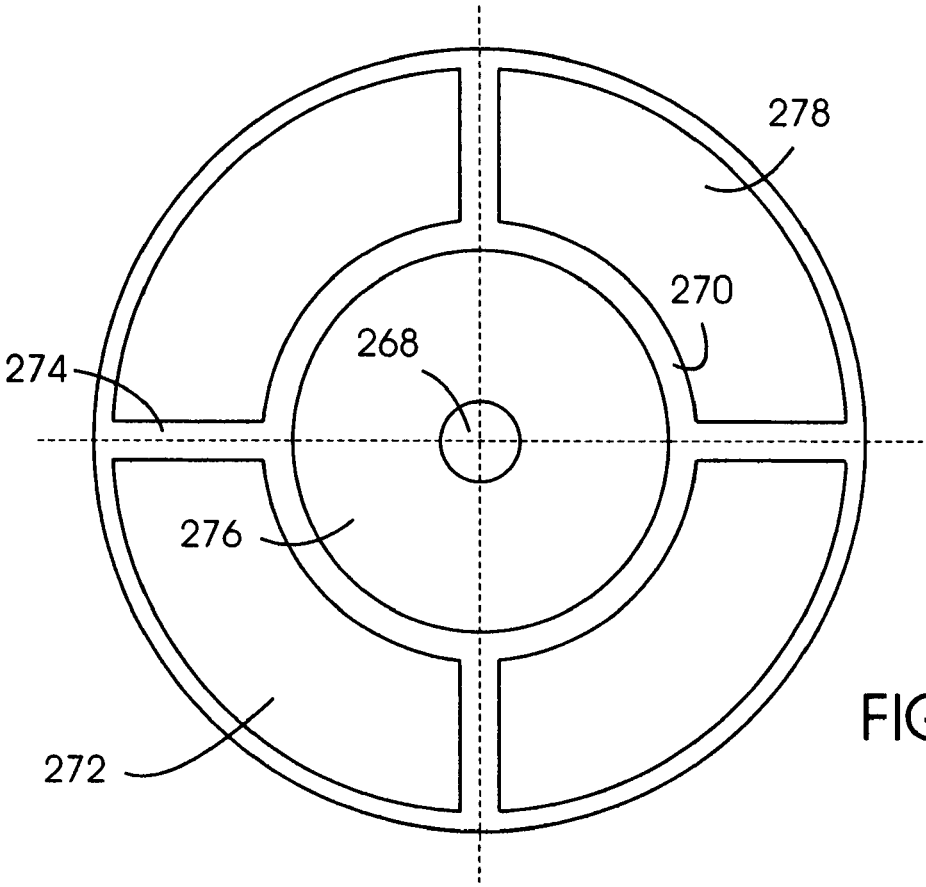
FIG. 28 shows a bottom view of a foot pad of the present invention.

FIGS. 27-28 show an alternative embodiment of a foot pad 260. The foot pad 260 is generally a resilient, pliant material, that attaches to the dome-shaped foot 234 by deforming the foot pad 260 and slipping the foot pad 260 onto the foot 234. The foot pad 260 is held in place by a retaining flange 262 and a ring-shaped inner lip 264 at the top of the foot pad 260. A bowl-shaped depression 266 is defined in the top of the foot pad 260. The foot pad 260 has a central cavity 268 and a circumferential groove 270 defined on a bottom surface 272 of the foot pad 260. A radial channel 274 provides a fluid pathway between the circumferential groove 270 and an ambient environment. The circumferential groove 270 surrounds a circular contact face 276 that engages the walking surface. The circumferential groove 270 and the radial channels 274 define four segmented faces 278 that also engage the walking surface. As best seen in FIG. 27, the bottom surface 272 is slightly convex.

The bottom surface 272, along with the circumferential groove 270, the radial channels 274, and the center cavity 268 defined therein, determine the traction between the foot pad 260 and the walking surface. The shape of the bottom surface 272 provides a significant area of contact with the walking surface, regardless of whether the user of the walking aid is standing still or walking on the walking surface. The material forming the foot pad 260 should be rubber or other flexible material that conforms readily to the contours of the walking surface, provides a high degree of friction, and is resistant to wear.

The design of the foot pad 260 described above allows liquids on the walking surface to be expelled outward through the radial channels 270 as a weight of the user is applied to the walking aid. Loose debris, such as sand and dirt, which might otherwise reduce traction, may be expelled by air pressure as the user exerts weight on the walking aid and thereby flattens the convex bottom surface 272. The slightly convex shape of the bottom surface 272, combined with the central cavity 268, the circumferential groove 270, and the radial channels 274, is designed to: (a) compress and expel air and water that may reduce frictional contact with the walking surface, and (b) under the weight of the user, create a partial vacuum with smooth and slick walking surfaces in order to combine adhesion with friction to optimize and sustain traction.

The foot pad 260 is also designed to be resistant to hydroplaning. Just as a car may hydroplane while driving on wet pavement, a traditional crutch foot can hydroplane when a user walks on a wet surface using crutches. The bottom surface of the foot pad 260 has been designed to expel water through the circumferential groove 270 and the radial channel 274 and, thus, reduce the likelihood of hydroplaning of the foot pad 260 while walking over a wet walking surface.

The upper surface of the foot pad 260 is shaped to mate with the dome-shaped foot 234. The mating of the irregularly shaped foot pad 260 and the foot improves stability of the foot pad 260 under normal operation. The shape of the retaining flange 262 and the inner lip 264 facilitates easy replacement of worn foot pads 260 and also helps to keep the foot pad securely on the dome-shaped foot 234.

Figure 29:
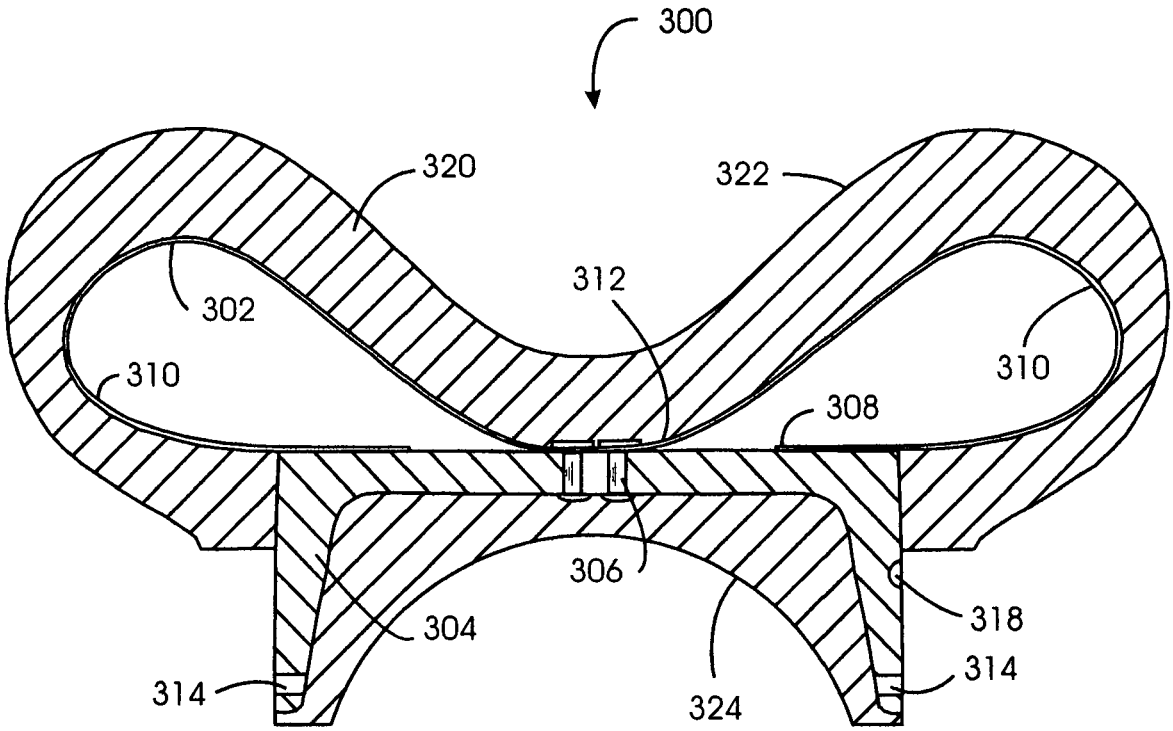
FIG. 29 shows a partial, cross-sectional view of the shoulder support assembly shown in FIG. 1

FIGS. 29-32 show various views of the pivoting shoulder support 104 for the adjustable multi-purpose crutch 100. FIG. 29 shows a cross-sectional view of an upper portion 300 of the shoulder support 104. A shoulder spring 302 is attached to a channel section 304 by two rivets 306. The shoulder spring 302 has two floating spring ends 308 that are not attached to the channel section 304. The shoulder spring 302 is bent in a bow-tie shape and has two loops 310 with a narrow portion 312 at which the shoulder spring 302 is secured to the channel section 304.

Figure 30:
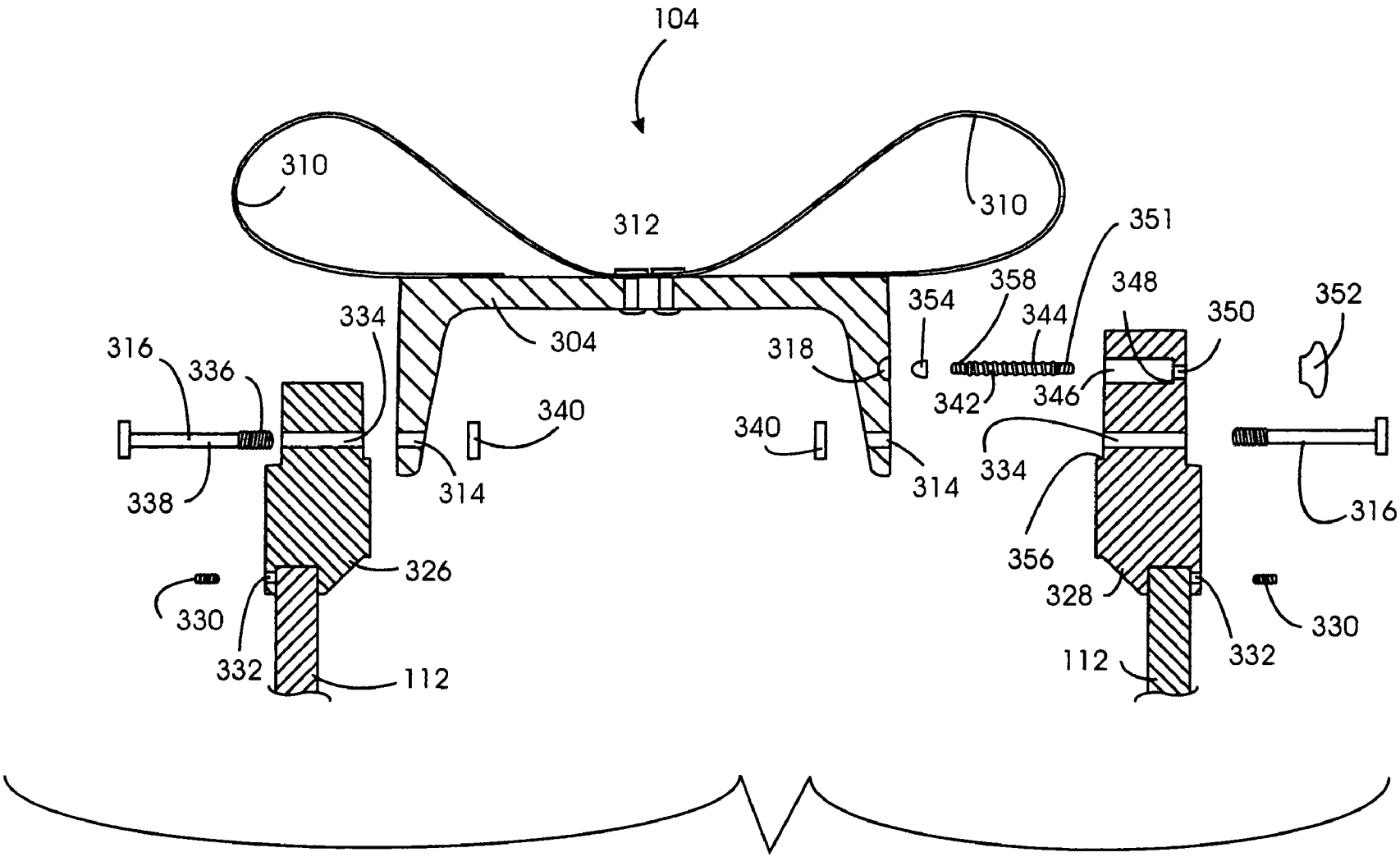
FIG. 30 shows a partial, exploded view of the shoulder support assembly shown in FIG. 1.

As seen in FIG. 29, two bolt holes 314 are formed at lower ends of the channel section 304 to receive pivot bolts 316 (shown in FIG. 30). An indentation 318 is formed in a side of the channel section 304. The purpose of the indentation 318 will be discussed in the description of FIG. 30. A shoulder pad 320 covers the shoulder support upper portion 300 for cushioning the shoulder support upper portion 300 for use under a person's arm.

The shoulder support upper portion 300 is designed so that the person's underarm rests on top of the shoulder pad 320 between the two loops 310. Although users are typically advised to support the user's weight with the hands, many users find themselves resting their weight on the shoulder supports. When a long-term crutch user uses ordinary crutches, the supporting of one's weight by resting the underarms on the shoulder supports contributes to neuropathy in the shoulder area.

The shoulder support 104 has a concave downward upper surface 322 which is positioned beneath an underarm of a user and a concave upward lower surface 324. The lower surface 324 is concave to accommodate a forearm of the user when the user positions the adjustable crutch 100 at a mid-arm position or a lower position.

FIG. 30 is a partial section view, and a partial exploded view of the shoulder support 104. The shoulder pad 320 is not shown to add clarity to FIG. 30. The shoulder support 104 is pivotally attached to a first tube cap 326 and a second tube cap 328 that are each positioned atop one of the telescoping upper tubes 112. As best seen in FIG. 30, the tube caps 326 and 328 are attached to the upper tubes 112 by tube set screws 330. The tube set screws 330 are screwed into threaded tube cap set screw holes 332 and apply a force on the upper tubes 112 when tightened. Although tube set screws 330 are shown in FIG. 30, it is anticipated that rivets may also be used to attach the tube caps 328 to the tubes 112.

The shoulder support channel section 304 pivots on pivot bolts 316 that pass through tube cap holes 334 and bolt holes 314. Each pivot bolt 316 is generally cylindrical with a threaded portion 336 and an non-threaded portion 338. A nut 340 is attached to the end of the pivot bolt 316.

The second tube cap also has a stud bolt 342 which is positioned inside a stop spring 344. The stop spring 344 fits inside a first bore 346 in the second tube cap 328 and abuts a shoulder 348 formed at a plane where the first bore 346 becomes narrowed to a second bore 350. Once the stop spring 344 is positioned inside the first bore 346, the stud bolt 342 may be inserted through the stop spring and through the first bore 346 and the second bore 350. A knob 352 is positioned on a first end 351 of the stud bolt 342 and a stop 354 is positioned on a second end 358 of the stud bolt 342. The stop 354 is sized and shaped to fit into indentation 318.

The stud bolt 342 has a length selected so that, when the shoulder support 104 is assembled and the knob 352 is pulled by a user, the stop 354 is removed from the indentation 318. When the knob 352 is released, and the indentation 318 is aligned with the stop 354, the stop fits into the indentation 318. A spring constant of the stop spring 344 should be selected so that a person with little hand strength is capable of pulling the knob 354. A ridge 356 on each tube cap 326 and 328 prevents the pivoting channel section 304 from rotating more than 180 degrees.

Figure 31:
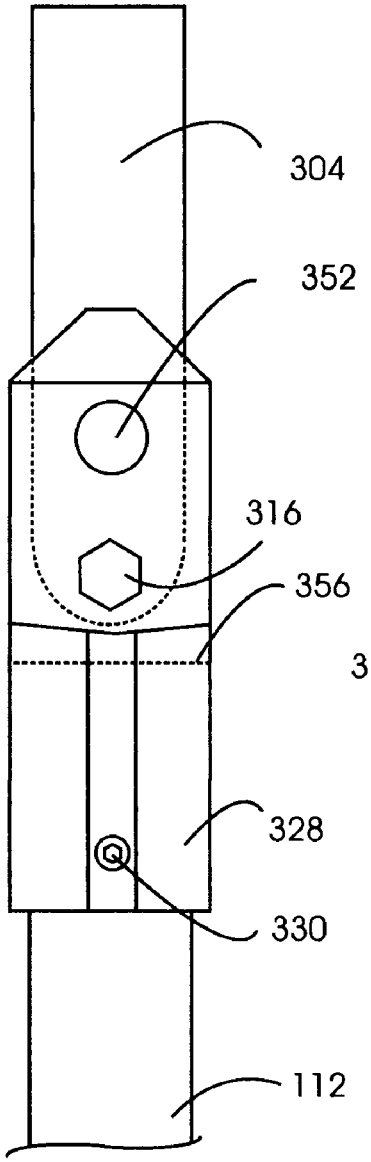
FIG. 31 shows a schematic view of a part of the shoulder support assembly shown in FIG. 1.
Figure 32:
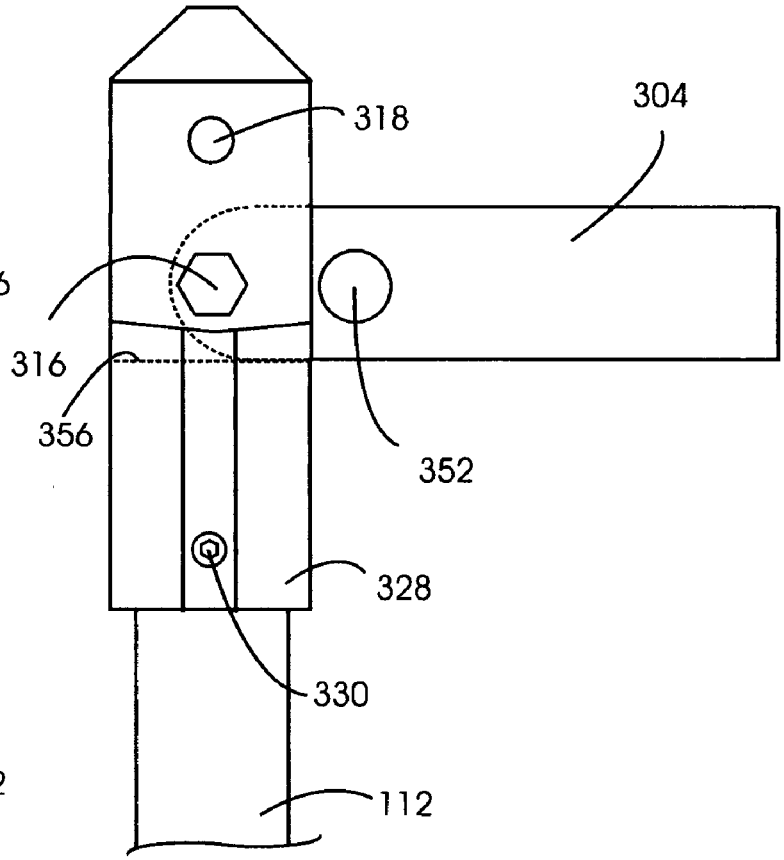
FIG. 32 shows a schematic view of a part of the shoulder support assembly shown in FIG. 1.

FIGS. 31-32 show schematic views of the pivoting action of the channel section 304 with respect to the tub caps 328. The channel section 304 pivots about the pivot bolt 316 which fits through the tube cap opening 334 (shown in FIG. 30). FIG. 31 shows the channel section 304 in an upright position. When the user wishes to move the channel section 304, and in turn the shoulder support 104, to another position, the user pulls the knob 352 to retract the stop 354 from the indentation 318 and then applies a force to the side of the channel section 304 causing the channel section 304 to pivot about the pivot bolt 316. The channel section 304 can pivot only ninety degrees in either direction because the ridge 356 blocks rotating the channel section 304 past ninety degrees.

It is generally expected that most users will find the shoulder support 104 more comfortable in a vertical or upright position when the adjustable crutch 100 is used beneath the underarms. Generally, this will be the fully extended position, as appropriate for that user's height, as shown in FIG. 1. When the crutch is lowered to the mid-arm position shown in FIG. 2, the user will probably want to have the shoulder support 104 used at an angle. When the adjustable crutch is in the retracted position shown in FIG. 3, the user will probably prefer to have the shoulder support 104 used in a horizontal position, as shown in FIG. 32. In this position, the adjustable crutch may be used as a cane and the shoulder support lower surface 324 provides support to the forearm and wrist of the user for added leverage and control.

Figure 33:
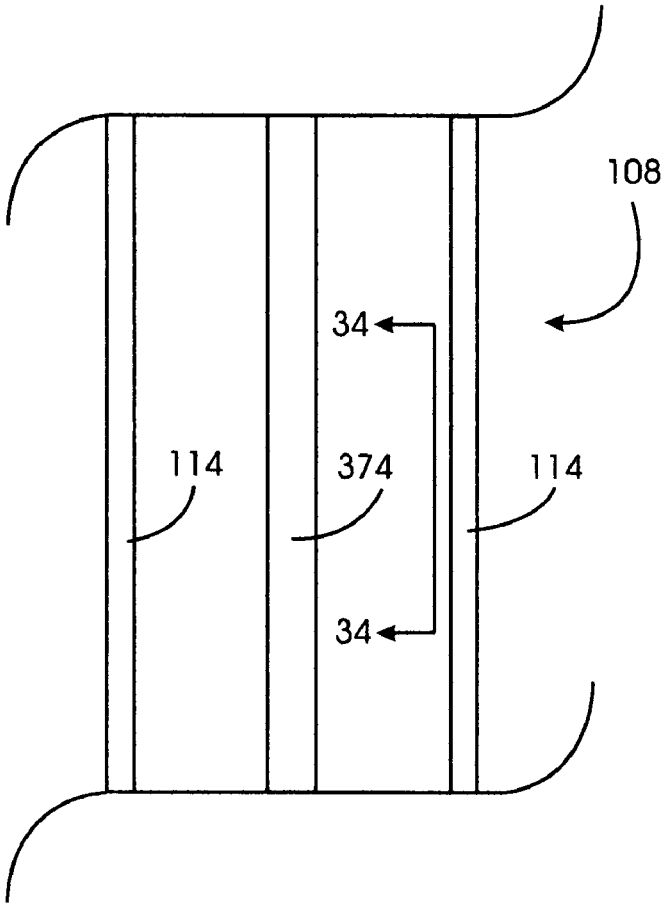
FIG. 33 shows the detail 24 of a portion of a frame as shown in FIG. 1.
Figure 34:
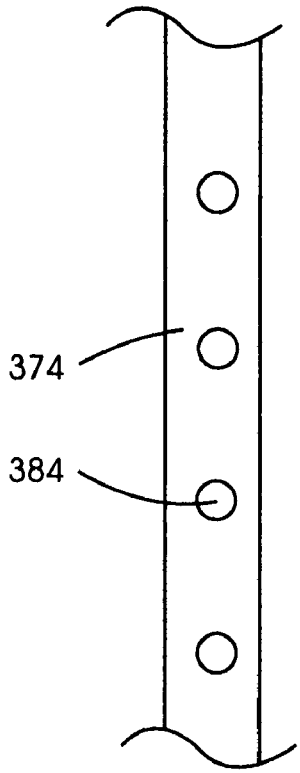
FIG. 34 shows a front elevation view of a column shown in FIG. 33.
Figure 35:
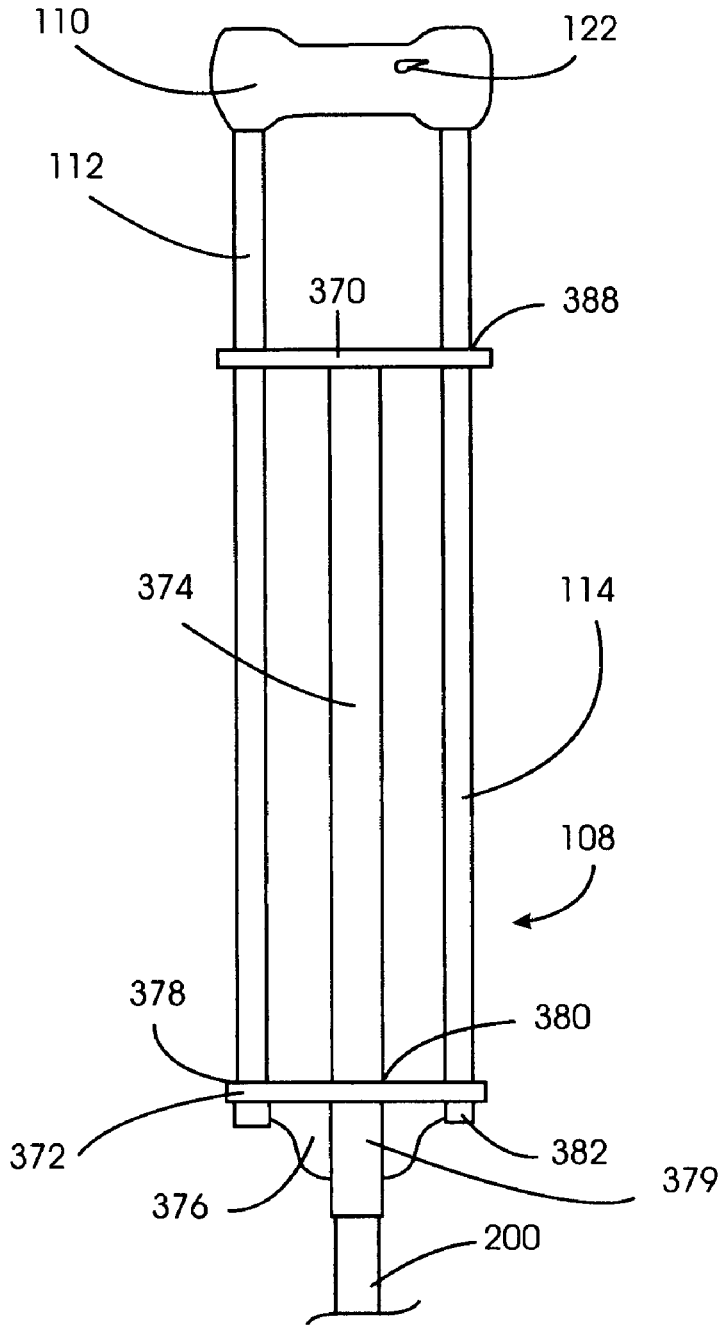
FIG. 35 shows a detailed view of a portion of the frame shown in FIG. 1

As seen in FIGS. 33-35, the frame 108 includes the handle 110, the two lower tubes 114, an upper cross plate 370, a lower cross plate 372, and a column 374 that extends from the upper cross plate 370 to a position just below the lower cross plate 372. A torsion-resistant webbing 376 extends below the lower cross plate 372.

The column 374 is welded to and extends from an underside of the upper cross plate 370. A column lower end 379 passes through a column opening 380 defined in the lower cross plate 372. Lower ends 382 of the lower tubes 114 are open so that the upper tubes 112 may extend beyond the lower tubes' lower ends 382.

Figure 36:
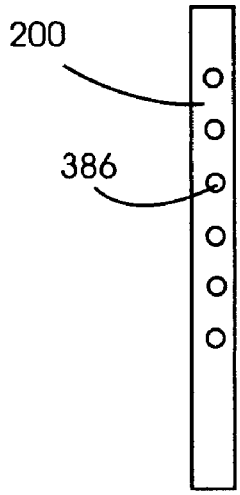
FIG. 36 shows an elevation view of the strut shown in FIG. 35.

As best seen in FIG. 34, the column 374 has adjustment holes 384 defined therein on opposing sides of the column 374. The strut 200, shown in FIG. 36, slides inside the column 374 and has strut openings 386 defined therein on opposing sides of the strut. The position of the strut 200 within the column 374 is fixed by a V-spring. The position of the strut 200 may also be fixed by a simple pin that protrudes through the column adjustment holes 384 and the strut openings 386.

Figure 37:
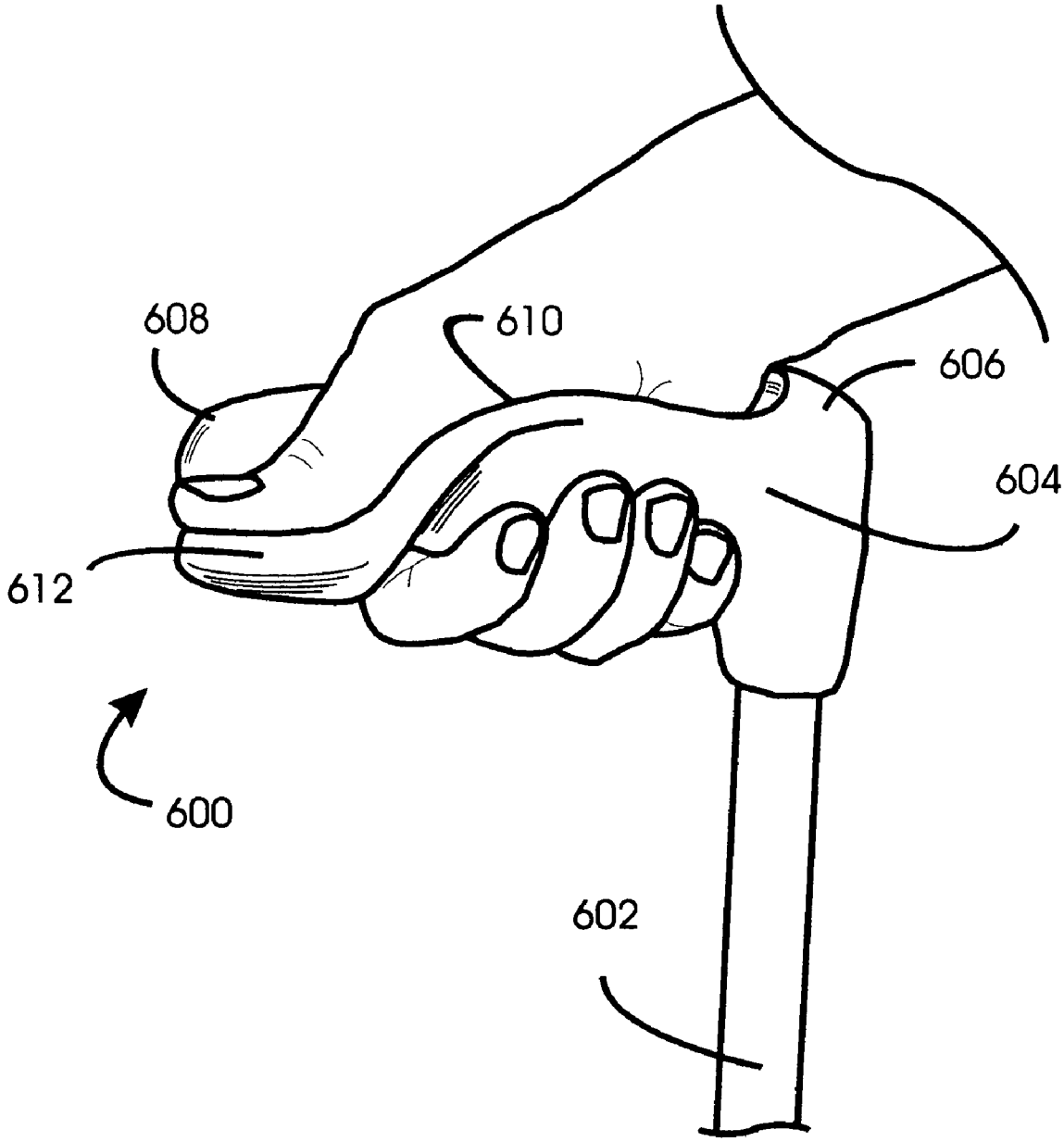
FIG. 37 shows a perspective view of a handle of the present invention atop a cane.
Figure 38:
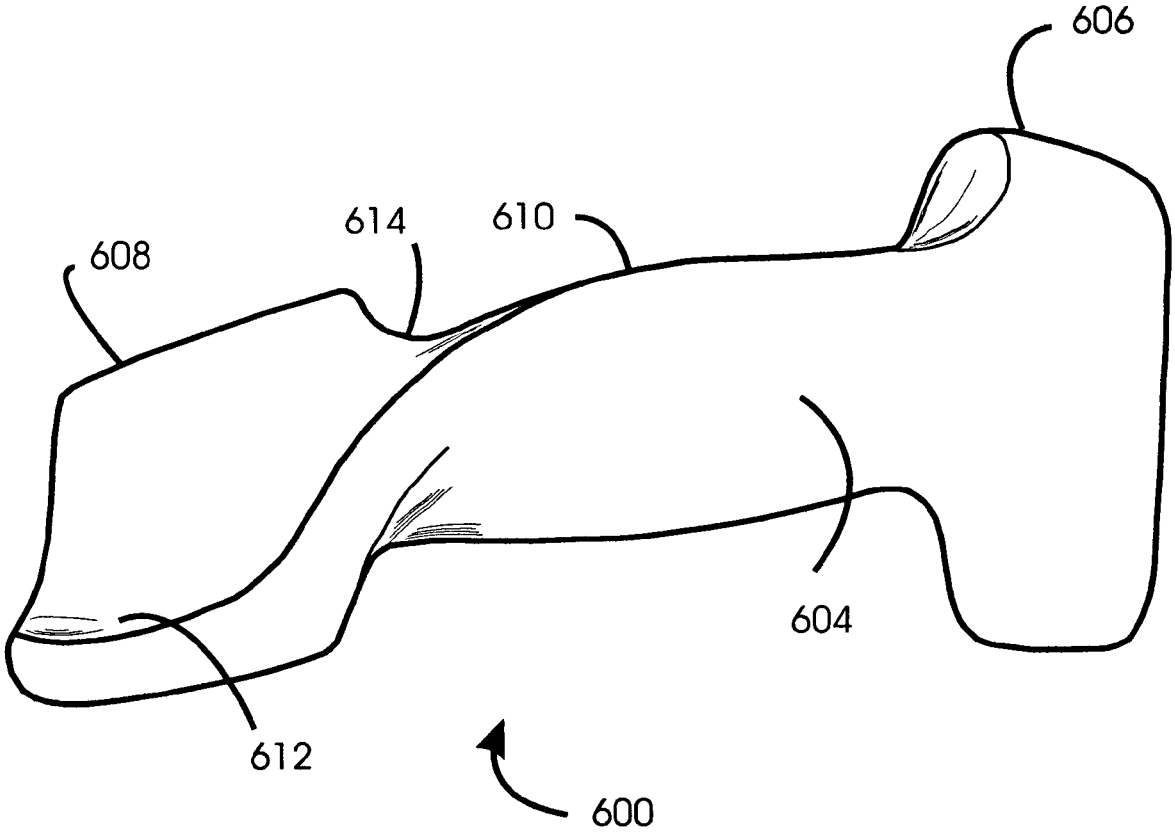
FIG. 38 shows a perspective view of the handle shown in FIG. 37.

FIGS. 37-38 show an embodiment of a handle 600 similar in its outside geometry to the handle 110, but the handle 600 rests atop a cane 602. The handle 600 has a body 604 with a rear post 606, a front post 608, and a palm grip 610 where the person's palm contacts the handle 600 upon gripping. The handle 600 also has a web 614 where a web of a person's hand between the thumb and the first finger contacts the handle 600 upon gripping. The handle 600 has a thumb rest 612 where the user's thumb is positioned when gripping the handle 600. The thumb rest 612 is a contoured ridge formed on a side of the handle 600. The thumb rest 612 is slightly wider than a person's thumb. The handle 600 may be attached to the cane 602 by set screws. The handle 600, like the handle 110, is shaped to prevent undue stresses from being exerted upon the muscles and tendons of the hand and wrist of a user.

When compared to the handle 110, the handle 600 has a larger upper gripping surface, which is formed by the palm grip 610 and the web 614. The upper gripping surface also curves to more closely conform to the curvature of user's palm and fingers, making the grip around handle body 604 more comfortable. The handle 600 also has an extended thumb rest 612 that forms a greater portion of the overall width of the handle body 604, when compared to the handle 110. The increased area of the upper gripping surface, combined with the more closely conforming curves of the upper surface, enhances the user's ability of the user to grip the handle 600 and to control the handle 600.

A palm grip base 616 between the rear post 606 and the palm grip 610 also has an increased area, when compared with the handle 110. Because of this increased area, the user distributes the user's weight, which in turn results in less reactive pressure exerted by the handle 600 on the user's hand. An upward curve 618 of the palm grip base 616 also prevents the user's palm from spreading and, thus, improves the load distribution across the palm. When the handle 600 is used with the adjustable crutch 100, the upward curve 618 also provides a more comfortable separation of the user's hand from the upper tube 112 that protrudes through the rear post 606. For a traditional dowel-shaped crutch handle, the user's palm meets the crutch handle at a 90-degree angle, which can cause discomfort after the user applies his weight to the handle. The upward curve 618 reduces that discomfort.

A forward part 620 of the thumb rest 612 is also deepened on the inside of the user's thumb, when compared to the thumb rest 186 of handle 110. This feature enhances the user's grip on the handle 600 significantly. This relative "deepness" is due in part to having a higher web 614 at a base of the user's thumb when the user grips the handle 600.

The materials selected for the upper tubes and lower tubes may be steel, stainless steel, aluminum, titanium, carbon fiber composite material, or any alloys of these or other metallic materials. The materials selected for use must be rust and corrosion resistant in order to ensure the telescoping action of the upper tubes inside the lower tubes is not impeded. In one embodiment, the material used for the tubing is cold drawn aluminum, so that the tubes will be formed with high accuracy and with low tolerance for errors. The high accuracy of the cold drawing process is desirable because the upper tubes must reliably slide inside the lower tubes without jamming.

The material selected for the shoulder support may be wood, plastic, metal, polymer, rubber or any alloy or combination thereof. The material selected for all the components of the adjustable crutch should be inexpensive so that the cost of production of the adjustable crutch is kept low. Because the adjustable crutch 100 is to be used by disabled people, who may have atrophied muscles, all of the material should be light in weight. However, all of the material must have sufficient strength to perform the function intended.

The overall objective of this adjustable multi-purpose crutch is to improve and extend mobility for the handicapped by incorporating ergonomic and medical considerations in its design. The telescoping feature of the upper tubes 112 inside the lower tubes 114 permits simple adjustments allowing the user to adapt the adjustable crutch readily to changing environmental conditions. Less obvious are ergonomic features that address medical problems common to the traditional crutch with the express purpose of reducing or eliminating them. These problems are 1) loss of traction that may result in injury, 2) carpal tunnel syndrome, and 3) neuropathy.

Traction is improved with a foot assembly 116 featuring a spring-loaded swivel joint with a contoured foot pad. Up to an angle of about 25 degrees, the foot assembly 116 adapts readily to the supporting surface, providing immediate traction. Spring-loading the foot assembly 116 cushions and reduces the shock of impact with that surface. As the user moves forward into the next step, the unloading of this spring 216 provides an extra boost to the user. Once planted on the supporting surface, traction remains firm even when the user rotates.

In this design, adjustments in length or height of the crutch 100 are simple and need no tools. The medical practitioner and the user can make adjustments in a few seconds to fit the body proportions of the user. Adjustable configurations are listed below:

1) the full-length crutch height;

2) a mid-level height with horizontal positioning of the shoulder support functioning similar to the forearm crutch or "Canadian cane," giving forearm support;

3) telescoped to the height of a traditional cane with wrist support; and 4) fully telescoped.

Both of the latter two configurations can be achieved easily for storage in a car, restaurant, home, or overhead storage bin on an airliner or tour bus. In the mid-level configuration, when the crutch is pressed against the hip, the crutch provides considerable leverage that reduces hand strength needed to control body movement and the crutch itself.

Height adjustments of the telescoping of the crutch 100 are controlled by a locking mechanism 138 contained internally within the handle 110. On each handle 110, positioned strategically to minimize unintended release of the lock/release mechanism 138, is a single lock/release mechanism 138 to provide easy leverage for those with weakened hand strength. This lock/release mechanism 138 includes two spring-loaded locking pins 148 and 152 that engage the two sets of concentric vertical tubes 112 and 114 within the handle 110.

A primary contributing factor to carpal tunnel syndrome is repetitive rotation of the wrist and hands. Where the basic dowel-shape of the traditional crutch handle offers little restriction to this type motion, the handle of the present invention is designed to 1) align the hand and wrist in a natural position, vertically and horizontally, and 2) prevent such repetitive motion while in use. Several of the handle contours are critical in preventing or reducing abnormal pressures on certain nerves, tendons, and muscles. The term "natural position" means that the hand is in a position for which the muscles and tendons are in a state of reduced stress, when compared with the hand being in an "unnatural" position.

The importance of ergonomics in handle design for crutches is emphasized by an anomaly: medical practitioners caution the user to support their body weight by the handles, not the shoulder support, because of the risks of damage to nerves in the shoulder (neuropathy); yet, the majority of long-term users of crutches have weakened muscles in their forearms, wrists, and hands, and even those with normal strength levels are unaccustomed to such abnormal stress on those muscles. With the traditional crutch, following directions of their medical practitioner elevates fatigue levels quickly, and incurs the risk of carpal tunnel syndrome. If the patients do not follow those directions, and support their weight on the shoulder supports, they incur the risk of neuropathy. It is logical to incorporate every ergonomic design feature available into the contours of this handle that assists the user in obtaining maximum control and comfort, while minimizing muscular effort and medical risks.

Consistent with accepted procedures, standards, and goals in the medical community, the handles of this design are left- and right-oriented, and have greatly expanded upper weight-bearing surfaces that encourage supporting body weight on the handles rather than shoulder supports. With the hand positioned naturally on a handle, the handle's contours closely follow those of the hand. For example, a broadened, flattened upper weight-bearing surface begins at the base of the hand, and increases in width toward the front. It is comfortable, reduces fatigue, and restricts rolling and twisting motions of hands and wrists of the type that contribute to carpal tunnel syndrome problems. These complex ergonomic contours are not possible on a single, universal-purpose handle.

The angular positioning of the handle in relation to the vertical tubes is also critical in achieving the specific design objective of reducing or eliminating problems with carpal tunnel syndrome. In much the same way that the front wheels of a car are built with a "toe-in" alignment with the frame, human arms rotate at angles to the fore-and-aft centerline of the body. Accordingly, a similar "toe-in" effect is achieved in this design by raising the upper rear surface of the handle several degrees higher than the front (vertical alignment), and making the outside of the rear end of the handle wider than the front (horizontal alignment).

Since there is no central neural pathway in which nerves in the armpit area are concentrated, the problem of neuropathy is addressed by enlarging surface area and distributing the load on the shoulder support more evenly across the enlarged surface. The load-bearing surfaces of shoulder supports on traditional crutches generally represent a very shallow arc, and are narrow. For many users, this concentrates the load in the center of the shoulder support, and becomes a prime contributing factor in damage to nerves. Since these supports are typically static structures, the load remains centered as weight of the user is applied to it.

In the design of the present invention, at least four features are built into the shoulder support to address problems with neuropathy: 1) the load-bearing surface is enlarged to distribute the user's weight more evenly over a greater area, 2) the arc of the load-bearing surface is increased, 3) the load-bearing surface is spring-loaded to: a) readily flex and adapt under load to the contours of the user's shoulder, contributing to spreading the load more evenly, and b) complement the spring-loaded ball-joint foot in absorbing impact shocks to the user's shoulder area. In addition, the load-bearing surface is padded with a rubber cushion, and 4) the shoulder support may be turned horizontally to either side of vertical, to work in conjunction with either of the optional cane configurations. While it locks in the vertical position when used as a crutch, an index pin is provided at its base (on the front side for easy access by the user) to release the lock for conversion to cane-length configurations. Collectively, these features not only accommodate a broader spectrum of users (height-wise and weight-wise), but provide a substantially increased degree of comfort and mobility to all users. Muscles used with a crutch may differ somewhat from those used with a cane. With these optional configurations readily available, the user may rest some muscles by switching to another configuration, thereby reducing the onset of fatigue and extending endurance. According to field tests conducted by medical experts, these features succeed in providing greater comfort while simultaneously minimizing the risks of neuropathy.

While costs are an ever-present factor, design objectives for this walking aid are not primarily to lower costs to a minimum, but to improve mobility for those needing more comfortable and flexible mobility support, while reducing medical risks common to the traditional crutch, particularly for those faced with long-term use.

The above-described subject matter is to be considered illustrative, and not restrictive. The appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A foot assembly for a walking aid to assist a person in moving across a walking surface, the foot assembly being attached to a strut positioned at a lower end of the walking aid, the foot assembly comprising:

(a) a cylinder attached to a bottom of the strut, the cylinder having a cylinder wall that encloses a cylinder void with a cylinder void bottom, the cylinder having a generally concave bottom wall with a cylinder lower edge, wherein the cylinder bottom wall has a bottom opening defined therein;

(b) a dome-shaped foot with a hemispherical portion and a flat ring portion, the hemispherical portion having a dome hole defined at the top of the hemispherical portion, the dome having a circumferential wall, wherein the cylinder lower edge moves atop the outer surface of the foot hemispherical portion as the cylinder pivots about the foot;

(c) a foot bolt having foot bolt threads and a foot bolt head, wherein the foot bolt attaches the foot to the cylinder, wherein the foot bolt is positioned through the dome hole and the cylinder bottom opening, wherein the foot bolt is secured by a jam nut that tightens on the foot bolt threads to a predetermined torque to attach the foot hemispherical portion to the concave cylinder bottom wall, and wherein the dome-shaped foot swivels about the foot bolt within a sperical angle of travel defined by the circumferential wall of the dome hole;

(d) a generally circular spacer that fits onto the foot bolt and retains the foot bolt head inside the hemispherical portion of the foot, wherein the spacer having a diameter larger than a diameter of the dome hole, wherein the spacer substantially conforms to the inside surface of the foot hemispherical portion, and wherein the spacer has a tapered edge that defines a portion of a sphere that has substantially a same radius as an inside wall of the hemispherical portion of the dome-shaped foot; and (e) a resilient foot pad attached to a bottom of the foot flat ring portion.

2. The foot assembly of claim 1 further comprising at least one Belleville washer positioned on the foot bolt between the spacer and the foot bolt head.

3. The foot assembly of claim 1 further comprising at least two Belleville washers positioned on the foot bolt between the spacer and the foot bolt head, wherein aligning the Belleville washers in the same direction on the foot bolt provides a tighter joint formed between the cylinder and the foot, and wherein aligning the Belleville washers in opposite directions to each other provides a looser joint formed between the cylinder and the foot.

4. The foot assembly of claim 1 wherein the resilient foot pad is made from rubber to cushion the forces transmitted from a bottom of the resilient foot pad to the person using the walking aid.

5. The foot assembly of claim 1 wherein the walking aid is chosen from a group of walking aids consisting of a crutch, a cane and a walking stick.

6. The foot assembly of claim 1 wherein the resilient foot pad is attached to an underside of the foot flat ring portion by an adhesive.

7. The foot assembly of claim 1 further comprising:

(f) a through-bolt with threads positioned through a first opening defined in the cylinder, through opposed bores defined near a lower end of the strut, and through a second opening defined in the cylinder; and (g) a nut tightened on the through-bolt threads to attach the cylinder to the strut.

8. A foot assembly to support a device on a support surface, wherein the foot assembly is attached to a strut positioned at a lower end of the device, the foot assembly comprising:

(a) a cylinder attached to a bottom of the strut, the cylinder having a cylinder wall that encloses a cylinder void with a cylinder void bottom, wherein the cylinder has a generally concave bottom wall with a cylinder lower edge and wherein the cylinder bottom wall has a bottom opening defined therein;

(b) a dome-shaped foot with a hemispherical portion and a flat ring portion, wherein the hemispherical portion has a dome hole defined at the top of the hemispherical portion, wherein the dome hole has a circumferential wall, wherein the cylinder lower edge moves atop the outer surface of foot hemispherical portion as the cylinder pivots about the foot;

(c) a foot bolt having foot bolt threads and a foot bolt head, wherein the foot bolt pivotally attaches the foot to the cylinder, wherein the foot bolt is positioned through the dome hole and the cylinder bottom opening, wherein the foot bolt is secured by a jam nut that tightens on the foot bolt threads to a predetermined torque to attach the foot hemispherical portion to the concave cylinder bottom wall, and wherein the dome-shaped foot swivels about the foot bolt within spherical angle of travel defined by the circumferential wall of the dome hole;

(d) a generally circular spacer that fits onto the foot bolt and retains the foot bolt head inside the hemispherical portion of the dome-shaped foot, wherein the spacer has a diameter larger than a diameter of the dome hole, wherein the spacer substantially conforms to the inside surface of the foot hemispherical portion, and wherein the spacer has a tapered edge that defines either a portion of a surface of a sphere or a wedge; and (e) a foot pad that engages the support surface and is attached to a bottom of the foot flat ring portion, wherein the foot pad has a larger area than a bottom of the strut such that a weight bearing on the device is distributed over a larger area of the support surface.

9. The foot assembly of claim 8 further comprising at least two Belleville washers positioned on the foot bolt between the spacer and the foot bolt head, wherein aligning the Belleville washers in the same direction on the foot bolt provides a tighter joint formed between the cylinder and the foot, and wherein aligning the Belleville washers in opposite directions to each other provides a looser joint formed between the cylinder and the foot.

10. A foot assembly for a walking aid to assist a person in moving across a walking surface, wherein the foot assembly is attached to a strut positioned at a lower end of the walking aid, the foot assembly comprising:

(a) a cylinder attached to a bottom of the strut, the cylinder having a cylinder wall that encloses a cylinder void with a cylinder void bottom, wherein the cylinder has a generally concave bottom wall with a cylinder lower edge and wherein the cylinder bottom wall has a bottom opening defined therein;

(b) a dome-shaped foot with a hemispherical portion and a flat ring portion, wherein the hemispherical portion has a dome hole defined at the top of the hemispherical portion, wherein the dome hole has a circumferential wall, wherein the cylinder lower edges moves atop the outer surface of foot hemisperical portion as the cylinder pivots about the foot;

(c) a foot bolt having foot bolt threads and a foot bolt head, wherein the foot bolt pivotally attaches the foot to the cylinder, wherein the foot bolt is positioned through the dome hole and the cylinder bottom opening, and wherein the foot bolt is secured by a jam nut that tightens on the foot bolt threads to a predetermined torque to attach the foot hemipsherical portion to the concave cylinder bottom wall, wherein the dome-shaped foot swivels about the foot bolt within a spherical angle of travel defined by the circumferential wall of the dome hole, and wherein the foot assembly adapts to the supporting surface up to an angle of 25 degrees;

(d) a generally circular spacer that fits onto the foot bolt and retains the foot bolt head inside the hemispherical portion of the foot, wherein the spacer has a diameter larger than a diameter of the dome hole, wherein the spacer substantially conforms to the inside surface of the foot hempispherical portion, and wherein the tapered edge of the spacer defines either a portion of a surface of a sphere or a wedge; and (e) a resilient foot pad attached to a bottom of the foot, wherein the resilient foot pad reduces the forces transmitted between a bottom of the resilient foot pad and the walking aid, wherein the cylinder lower edge moves atop the outer surface of foot hemispherical portion as the cylinder pivots about the foot and wherein the foot hemispherical portion supports any weight exerted by the person on the walking aid.

11. The foot assembly of claim 10 wherein the foot pad comprises a resilient material having circumferential grooves and radial channels formed therein to define a circular contact face with segmented faces positioned about the contact face.

12. The foot assembly of claim 10 wherein the resilient foot pad is attached to the foot flat ring portion by deforming the foot pad and slipping the foot pad onto the foot flat ring portion.

13. The foot assembly of claim 10 wherein a joint formed between the cylinder and the dome-shaped foot is not a rigid joint.

* * * * *

UNITED STATES PATENT AND TRADEMARK OFFICE

CERTIFICATE OF CORRECTION

PATENT NO. : 7,588,044 B2
APPLICATION NO. : 11/707297
DATED : September 15, 2009
INVENTOR(S) : William H. Baker It is certified that error appears in the above-identified patent and that said Letters Patent is hereby corrected as shown below:

Column 15, line 37, ninth line of paragraph (c) of Claim 1, please delete "sperical" and substitute "spherical" therefor.

Column 15, line 41, third line of paragraph (d) of Claim 1, please delete "wherein".

Column 16, line 35, ninth line of paragraph (c) of Claim 8, please insert --a-- between "within" and "spherical".

Signed and Sealed this

Twenty-seventh Day of October, 2009

David J. Kappos

David J. Kappos
*Director of the United States Patent and Trademark Office*